US010604991B2

(12) United States Patent
Schweiss

(10) Patent No.: US 10,604,991 B2
(45) **Date of Patent: *Mar. 31, 2020**

(54) OVERHEAD DOOR AND FRAME ASSEMBLY

(71) Applicant: Michael L. Schweiss, Fairfax, MN (US)

(72) Inventor: Michael L. Schweiss, Fairfax, MN (US)

(73) Assignee: Sorrel Quarters, LLC, Hector, MN (US)

( * ) Notice: Subject to any disclaimer, the term of this patent is extended or adjusted under 35 U.S.C. 154(b) by 508 days.

This patent is subject to a terminal disclaimer.

(21) Appl. No.: 15/232,447

(22) Filed: Aug. 9, 2016

(65) Prior Publication Data

US 2016/0362929 A1 Dec. 15, 2016

Related U.S. Application Data

(63) Continuation-in-part of application No. 14/751,620, filed on Jun. 26, 2015, now Pat. No. 10,316,576.
(Continued)

(51) Int. Cl.
*E06B 3/38* (2006.01)
*E05F 15/53* (2015.01)
(Continued)

(52) U.S. Cl.
CPC ..... *E06B 3/38* (2013.01); *E05D 3/02* (2013.01); *E05D 5/12* (2013.01); *E05D 7/009* (2013.01); *E05F 15/53* (2015.01); *E05F 15/622* (2015.01); *E06B 3/01* (2013.01); *E05Y 2600/45* (2013.01); *E05Y 2900/106* (2013.01); *E05Y 2900/108* (2013.01); *E06B 1/522* (2013.01); *E06B 2003/7044* (2013.01)

(58) Field of Classification Search
CPC .... E06B 3/38; E06B 2003/7044; E06B 1/522; E05D 5/12; E05D 7/009; E05F 15/53; E05F 15/622; Y10T 16/531; Y10T 16/557; Y10T 16/558
See application file for complete search history.

(56) References Cited

U.S. PATENT DOCUMENTS 5,375,383 A * 12/1994 Lin ..... E06B 1/522 49/505
6,199,617 B1 * 3/2001 Schweiss ..... E05F 15/605 160/188
(Continued)

FOREIGN PATENT DOCUMENTS

GB 1 225 551 * 3/1971

OTHER PUBLICATIONS

Pending U.S. Appl. No. 14/751,620.

*Primary Examiner* — Gregory J Strimbu
(74) *Attorney, Agent, or Firm* — Richard John Bartz

(57) ABSTRACT

A frame assembly supporting an overhead door has a horizontal header connected to upright columns or posts with splice assemblies. Fasteners mounted on the columns cooperate with retainers on the splice assemblies to position and connect the columns to the header. Hinges pivotally mount the door on the header for movement between open and closed positions. Linear actuators connected to the frame assembly and door are operable to move the door between door open and door closed positions.

17 Claims, 24 Drawing Sheets

Related U.S. Application Data

(60) Provisional application No. 61/998,361, filed on Jun. 26, 2014.

(51) Int. Cl.

| | |
|---|---|
| ***E05F 15/622*** | (2015.01) |
| ***E05D 3/02*** | (2006.01) |
| ***E05D 5/12*** | (2006.01) |
| ***E06B 3/01*** | (2006.01) |
| ***E05D 7/00*** | (2006.01) |
| *E06B 1/52* | (2006.01) |
| *E06B 3/70* | (2006.01) |

(56) References Cited

U.S. PATENT DOCUMENTS 6,634,059 B2 * 10/2003 Seiferd ..... E05F 3/108 16/66
6,742,303 B2 6/2004 Pedemonte
6,866,080 B2 3/2005 Schweiss
6,883,273 B2 4/2005 Kerkvliet
7,290,310 B2 * 11/2007 Yamaguchi ..... E05D 5/10 16/234
8,584,319 B1 * 11/2013 Ludin ..... E05D 7/009 16/262
2002/0029524 A1 * 3/2002 Kerkvliet ..... E05D 11/00 49/200
2007/0220707 A1 * 9/2007 Eldon ..... E05D 5/02 16/221
2008/0295290 A1 * 12/2008 Murray ..... E05D 5/062 16/386
2009/0320377 A1 * 12/2009 Fulton ..... E06B 3/38 49/399
2010/0031573 A1 * 2/2010 Whiting ..... E05B 47/02 49/31
2010/0058668 A1 * 3/2010 Keller ..... E06B 3/38 49/197
2011/0225895 A1 * 9/2011 Peterson ..... E06B 7/22 49/506
2016/0215544 A1 * 7/2016 Smalls ..... E05D 7/009

* cited by examiner

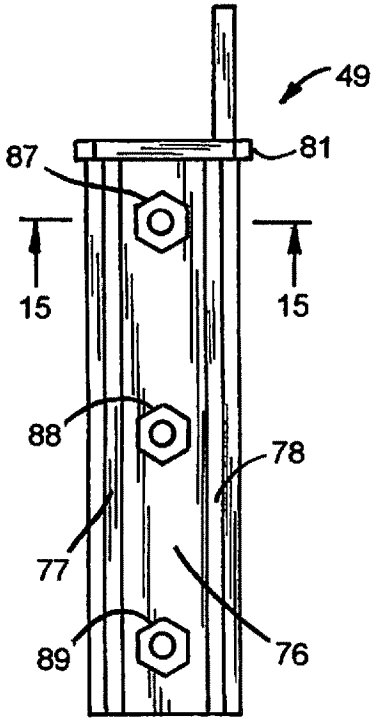
FIG.12
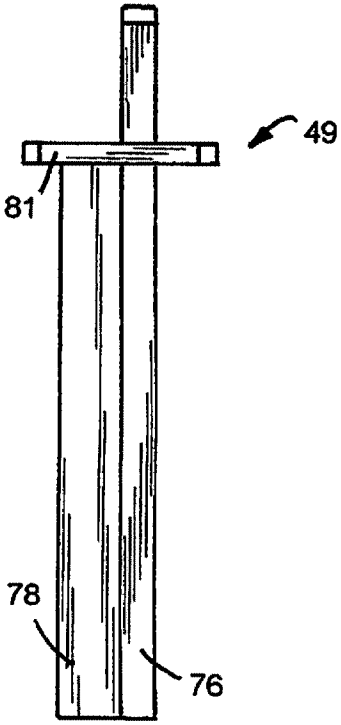
FIG.13
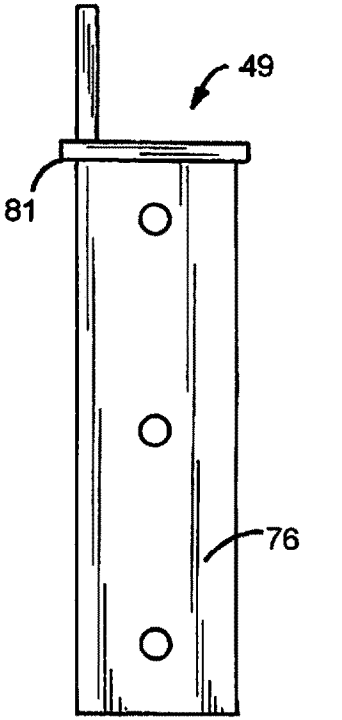
FIG.14
FIG.15
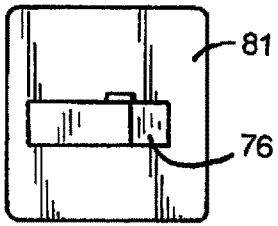
FIG.16
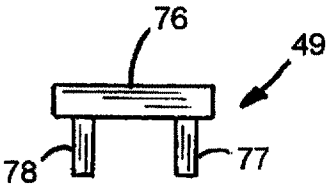
FIG.17

OVERHEAD DOOR AND FRAME ASSEMBLY

CROSS REFERENCE TO RELATED APPLICATION

This application is a continuation-in-part of U.S. application Ser. No. 14/751,620 filed Jun. 26, 2015. U.S. application Ser. No. 14/751,620 claims the priority of U.S. Provisional Application Ser. No. 61/998,361 filed Jun. 26, 2014.

FIELD OF INVENTION

The overhead door and frame assembly is in the art of structures that are used to selectively open and close a doorway of a building. The door is a one-piece door mounted with hinges to a header of the frame assembly. Hydraulic cylinders operate to swing the door between an upright closed position to a generally horizontal open position allowing vehicles and equipment to be moved through the doorway into and out of the building.

BACKGROUND OF THE INVENTION

Buildings have large openings or doorways for accommodating trucks, tractors, airplanes and equipment to be moved into and out of the interior spaces in the buildings. Common types of conventional doors used to open and close the doorways are horizontally sliding doors and two-piece center hinged doors known as bi fold doors. An example of a bi fold door is disclosed by M. L. Schweiss in U.S. Pat. No. 6,866,080. A plurality of hinges pivotally mount the bi fold door to the header of the building whereby the entire weight of the bi fold door is accommodated by the header and side jambs of the building. The overall vertical height of the doorway is compromised to compensate for the folded bi fold door. Overhead doors are used to open and close doorways to maximize the useable space of the doorway of the structures. An example of a hydraulically operated overhead door is disclosed by D. J. Kerkvliet in U.S. Pat. No. 6,883,273. Overhead doors are mounted with hinges load bearing frames that are separate from the building structures whereby the weight or load of the overhead doors is not subjected to the building headers or side jambs. The load bearing frames are known as free standing headers having header mainframes and upright legs. The legs are field welded on opposite ends of the headers. The legs must be straight, flush and flat with the headers to maintain the overhead doors in these aligned open and closed positions. Welding fixtures and tooling are used to maintain the alignment of the legs relative to the headers during the field welding operation. The welding of the legs to the headers requires welding skills, supplies, labor and time. R. Peterson in U.S. Patent Application Publication No. 2011/0225895 discloses a door hinged to a frame secured to a building structure. The frame has a header connected to the upright posts. Connectors join the posts to the header. Fasteners such as bolts secure the connectors to the posts. Welds are also disclosed as securing the fasteners to the upright posts. A plurality of hinges having plates secured to the frame header and door accommodate a rod pivotally mount and support the door on the frame.

SUMMARY OF THE INVENTION

This application is a continuation-in-part of U.S. application Ser. No. 14/751,620 titled Overhead Door and Frame Assembly and incorporated herein by reference. The overhead door and frame assembly of application Ser. No. 14,751,620 has an overhead door supported with hinges on a header of a frame assembly. The header is attached to upright columns with splice assemblies. Hydraulic cylinders connected to the door and columns are operable to move the door between an upright closed position and a generally horizontal open position. The invention is a frame assembly for supporting with hinges an overhead door operable to move between a generally upright closed position and a generally horizontal open position. The frame assembly has a horizontal header supported by upright columns. Splice assemblies secured to the header connect the columns to opposite ends of the header. The splice assemblies include cooperating retainers and fasteners that align the columns with the header and maintain the columns straight, flush and in the same upright plane of the header. A plurality of hinges pivotally connect a top member of the door frame to the header of the frame assembly. Linear actuators such as hydraulic cylinders or motor driven screws connected to the door and columns operate to swing the door between an upright closed position and a generally horizontal open position. The frame assembly supports the weight of the door and absorbs the forces subjected to the door during the opening and closing of the door thereby eliminating most if not all weight and forces on the adjacent building structure. Each splice assembly has an upright body having a wall and opposite end edges. A plurality of upright ribs attached to the body are retained in a flat surface engagement with a column by adjustable fasteners connecting the column to the body. The fasteners include nuts secured to the body and bolts mounted on the column engageable with the nuts. In use, the bolts are turned to move the column into alignment with the header and secure the column to the splice assembly. A plurality of second adjustable fasteners comprise cooperating nuts and bolts. The bolts engage an edge of the body to hold the opposite edge of the body in engagement with the column concurrently with the engagement of the ribs with this column. The first and second adjustable fasteners retain the splice assembly in engagement with the perpendicular walls of the column. The hinges have header members and door members. The door members have sleeves rotatably mounted on non-rotatable pins. The sleeves are connected with plate members to the top member and upright members of the door frame. Header members mounted on pins adjacent the sleeves are secured to the header of the frame assembly whereby the hinges support the door on the header of the frame assembly for pivotal movement of the door between open and closed positions.

DESCRIPTION OF THE DRAWING

FIG. 12 is a front elevational view of a splice assembly separated from the frame assembly separated from the frame assembly header;

FIG. 13 is a right side elevational view of FIG. 12;

FIG. 14 is a rear elevational view of FIG. 12;

FIG. 15 is a sectional view taken along the line 15-15 of FIG. 12;

FIG. 16 is a top plan view of FIG. 12;

FIG. 17 is a bottom plan view of FIG. 12;

DETAILED DESCRIPTION OF THE OVERHEAD DOOR AND FRAME ASSEMBLY

Figure 1:
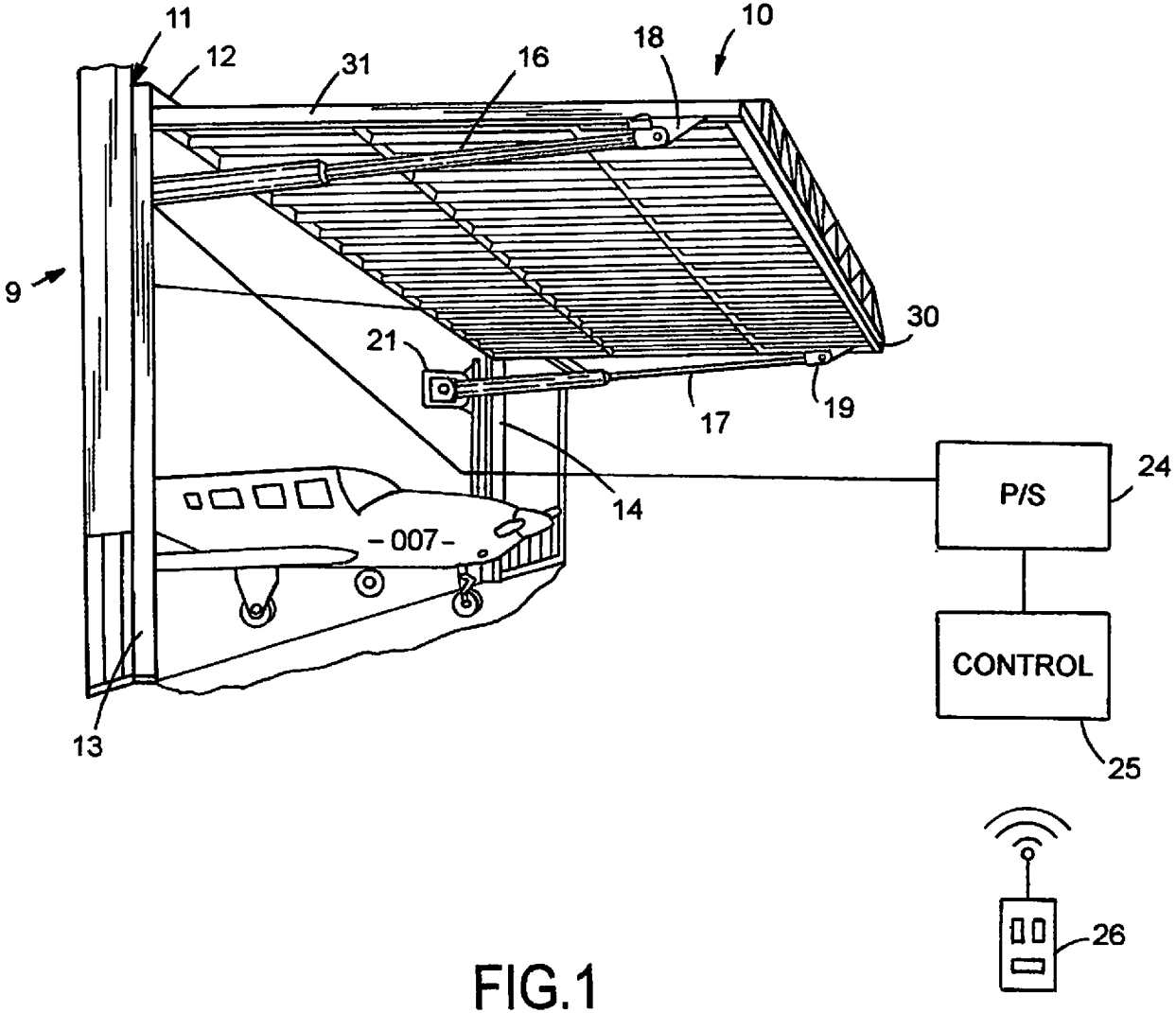
FIG. 1 is a perspective view of a building equipped with an open overhead door pivotally mounted with hinges on a frame assembly for opening and closing a doorway of the building.

A building 9, shown in FIG. 1, has a doorway or opening to allow a vehicle to move into and out of the interior of the building. Examples of building 9 include aviation hangers, automotive shops, farm shops, commercial buildings, warehouses and manufacturing plants. An overhead door 10 mounted on a frame assembly 11 is movable between an upright closed position and a horizontal open position above the doorway of the building. Frame assembly 11 has a horizontal header 12 attached to upright columns or legs 13 and 14. Header 12 and columns 13 and 14 are steel tubular members. Door 10 is moved between open and closed positions with linear actuators, such as hydraulic cylinders 16 and 17 or electric motor operated screws. Mount members 18 and 19 connect the rod ends of hydraulic cylinders 16 and 17 to side members 31, 32 and 33, 34 of door frame 27. The dead ends of hydraulic cylinders 16 and 17 are pivotally connected to supports 21 and 22 secured to columns 13 and 14 of frame assembly 11. A hydraulic fluid pump 24 operatively connected to opposite ends of hydraulic cylinders 16 and 17 functions to control the flow of hydraulic fluid to and from hydraulic cylinders 16 and 17 whereby hydraulic cylinders 16 and 17 selectively move door 10 between its open and closed positions. The operation of pump 24 is regulated with a control 25. A remote signal device 26 used by a person to actuate control 25 whereby control 25 regulates pumps to supply hydraulic fluid to the hydraulic cylinders 16 and 17 to move the door between open and closed positions. An example of a hydraulic fluid system for a hydraulically operated overhead door with hydraulic cylinders is disclosed in U.S. Pat. No. 6,883,273. A linear actuator having a motor operated screw as disclosed in U.S. Pat. No. 6,742,303 can be used to move door 10 between its open and closed positions.

Figure 2:
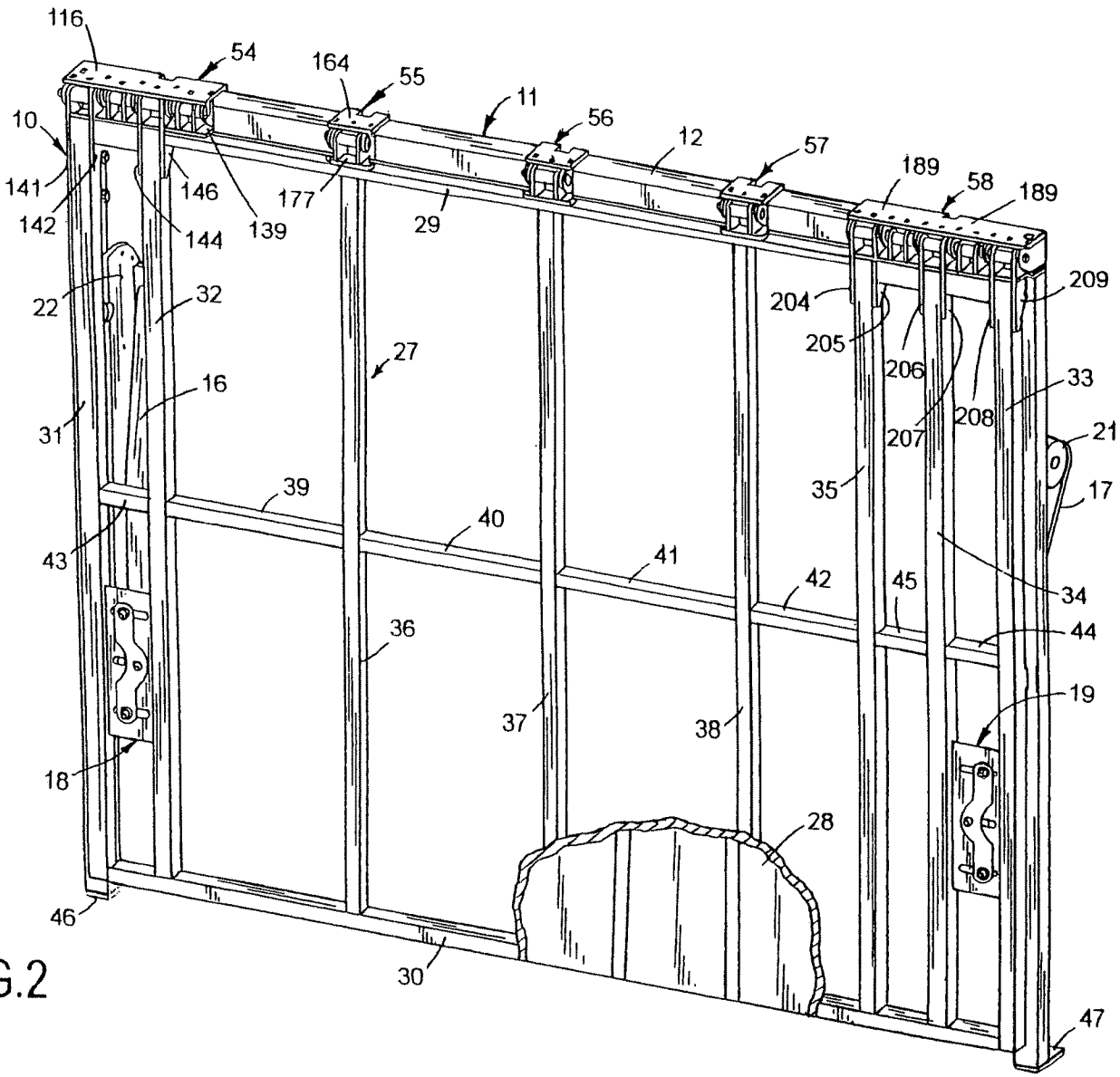
FIG. 2 is a perspective view of the closed overhead door frame mounted with hinges on the frame assembly.
Figures 3, 4:
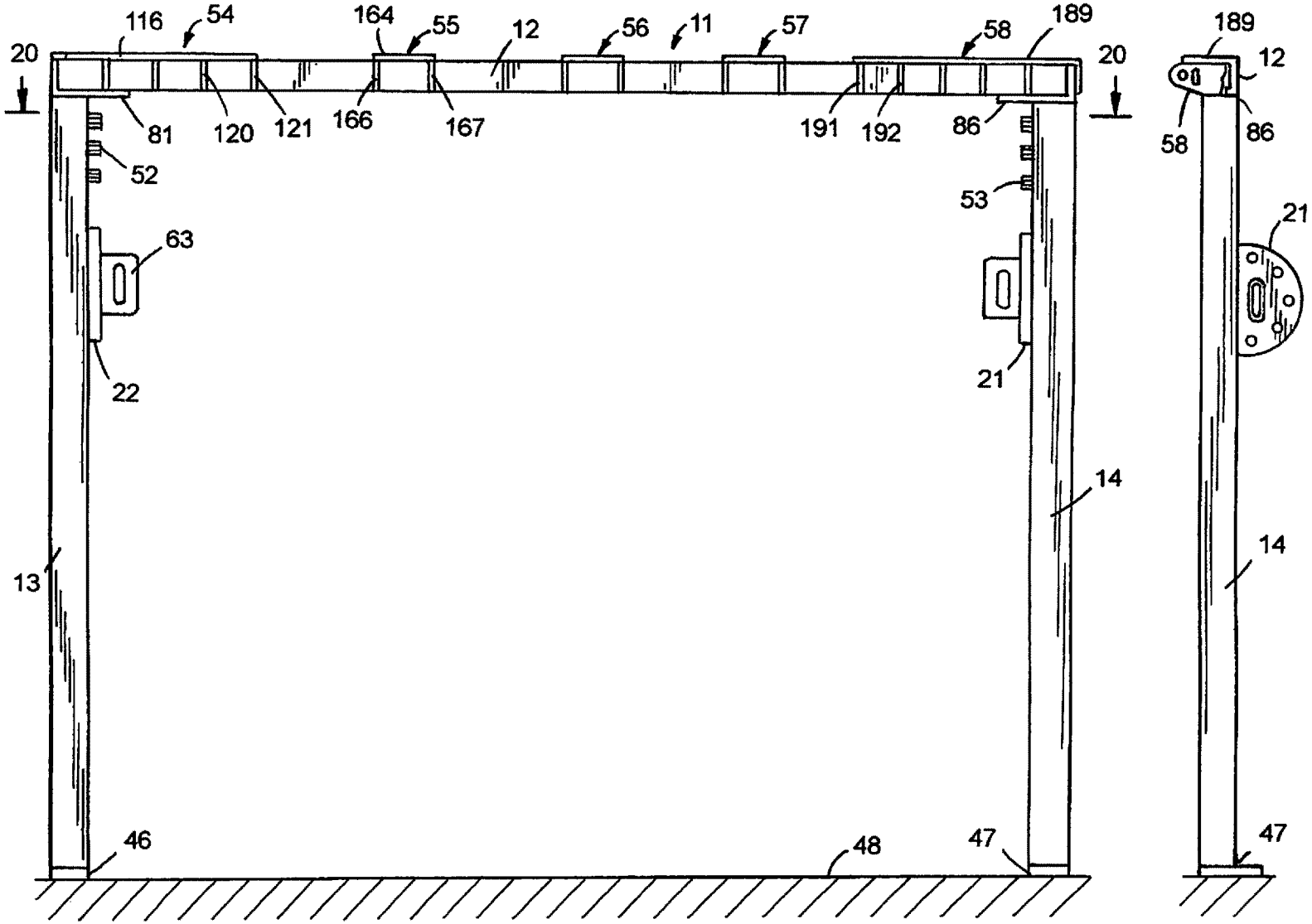
FIG. 3 is a front elevational view of the frame assembly of FIG. 2.
FIG. 4 is a right side elevational view of FIG. 3.

As shown in FIG. 2, door 10 has a rectangular door frame 27 supporting sheathing 28 and trim. Door frame 27, shown in FIG. 2, has upright left and right end members 31, 32 and 33, 34 connected with horizontal members 43 and 44. Middle upright members 35, 36, 37 and 38 are located between the end members 31, 32 and 33, 34. Horizontal members 39, 40, 41, 42 and 45 are connected to upright members 35, 36, 37 and 38. The upper ends of the upright members are connected to a horizontal door frame header 29. The lower ends of the upright members are connected to a bottom member 30. The end members 31, 32 and 33, 34 are also connected to header 29 and bottom member 30. The members and header of door frame 27 are tubular steel linear beams or members secured together with welds into a one-piece door frame. Sheathing 28 are one or more sheet members attached to the outsides of the members of door frame 27.

Figure 5:
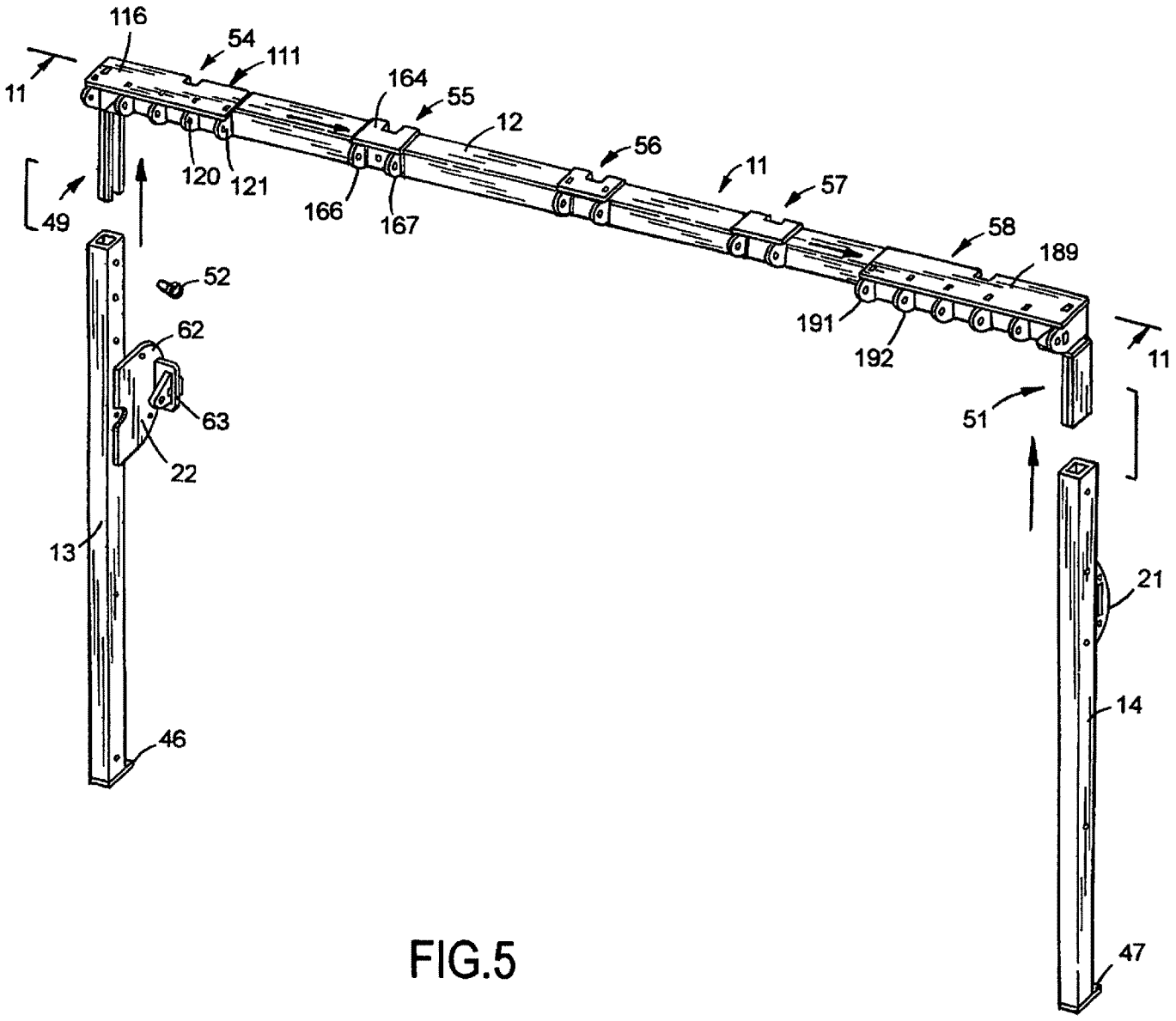
FIG. 5 is a perspective view of the frame assembly of FIG. 3 showing the frame assembly header separated from the upright side columns.
Figure 6:
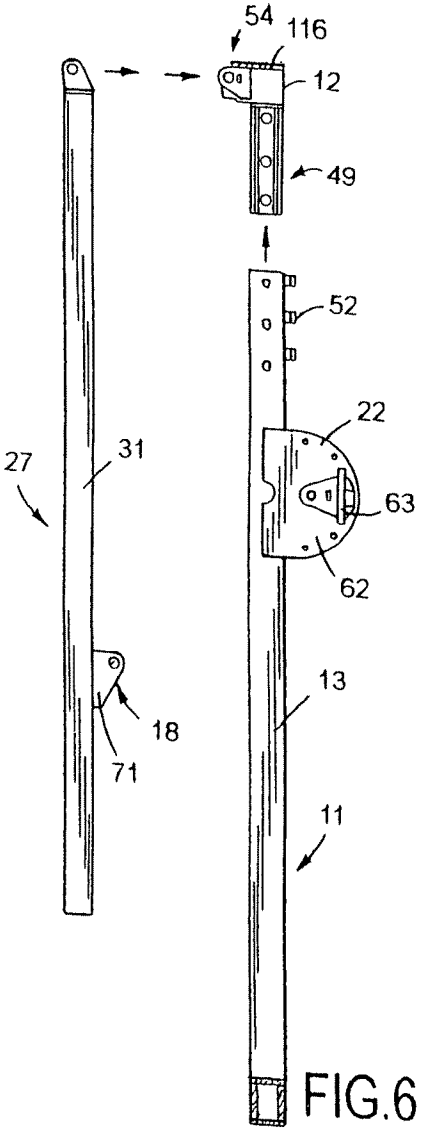
FIG. 6 is a side elevational view of the door frame separated from the frame assembly header and the upright side columns separated from the frame assembly header.

Frame assembly 11, shown in FIGS. 2 to 6, has a horizontal header 12 mounted on the upper ends of columns 13 and 14 with splice assemblies 49 and 51. Splice assemblies 49 and 51 align columns 13 and 14 with header 12 and maintain columns 13 and 14 straight, flush and in the same upright plane of header 12. A plurality of fasteners, 52 and 53, such as bolt and nut assemblies, secure columns 13 and 14 to splice assemblies 49 and 51. As shown in FIG. 6, the upper end of column 13 telescopes into splice assembly 49 attached with welds to header 12. Supports or shoes 46 and 47 secured to the bottom of columns 13 and 14 are adopted to accommodate anchors (not shown) attached to floor 48, such as a concrete floor.

A plurality of hinges 54, 55, 56, 57 and 58 pivotally mount door 10 to header 12 of frame assembly 11 for movement about a horizontal axis between an upright closed position and a generally horizontal open position adjacent the top of the doorway of building 9. Hinges 54 to 58 are located laterally adjacent the outside surface of header 12 and parallel to the length of header 12. Hinges 54 to 58 uniformly distribute the weight of door 10 to frame assembly 11 and maintain door 10 level during its opening and closing movements. The doorway structure of building 9 is not subjected to the weight of door 10 and hydraulic cylinders 16 and 17 that move door 10 to its open and closed positions.

Figure 8:
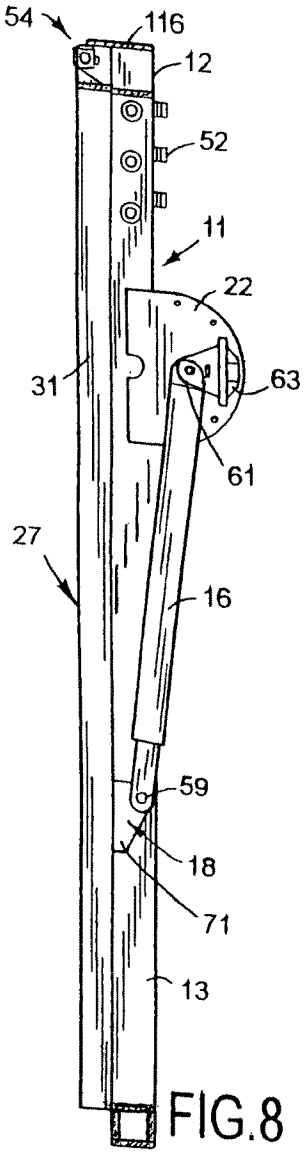
FIG. 8 is a side elevational view of the door frame and a piston and cylinder assembly mounted on the frame assembly with the door frame in the closed position.
Figure 7:
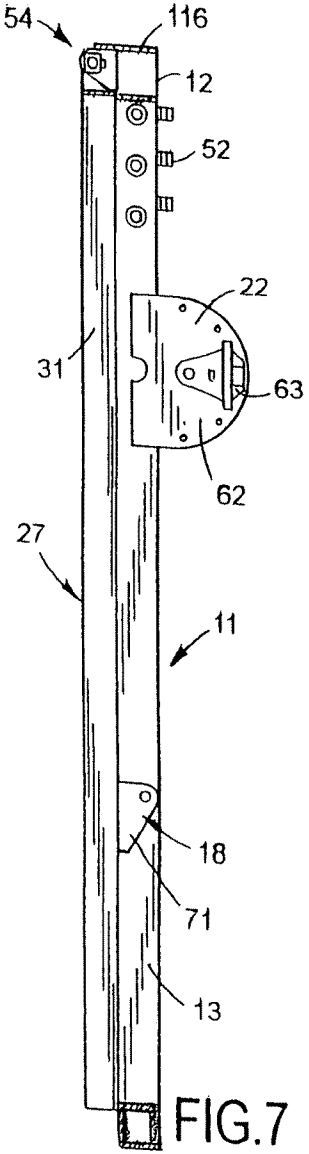
FIG. 7 is a side elevational view of the door frame mounted on the frame assembly with the door frame in the closed location.

As shown in FIG. 8, hydraulic cylinder 16 has a rod end pivotally connected with a pin 59 to mount 18 and a cylinder end pivotally connected with a pin or sleeve 61 to support 22. Support 22 comprises a semi-circular plate 62 welded to column 13. A bracket 63 secured to plate 62 accommodates pin 61 whereby cylinder 16 is pivotally connected to bracket 63. Cylinder 16 in FIG. 8 is in its retracted position holding door frame 27 in an upright position adjacent frame assembly 11. Hydraulic cylinder 17 operates in conjunction with hydraulic cylinder 16 to hold door 10 in its upright closed position. When hydraulic cylinders 16 and 17 are extended, as shown in FIG. 1, door 10 is retained in its horizontal open position. A hydraulic fluid system functions to supply hydraulic fluid under pressure to operate the hydraulic cylinders 16 and 17. A hydraulic fluid system for the hydraulic cylinders is disclosed in U.S. Pat. No. 6,742,303 and incorporated herein by reference. Linear actuators, such as motor driven screw devices, can be used to replace the hydraulic cylinders to open and closed door 10.

Figure 10:
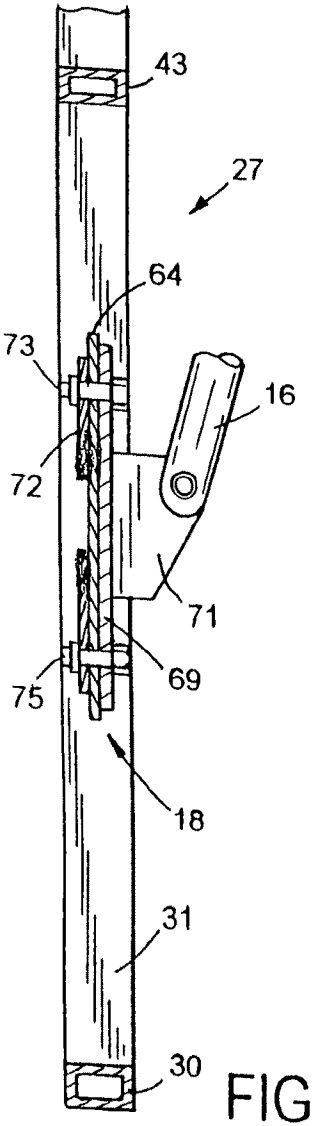
FIG. 10 is a sectional view taken along line 10-10 of FIG. 9.
Figure 9:
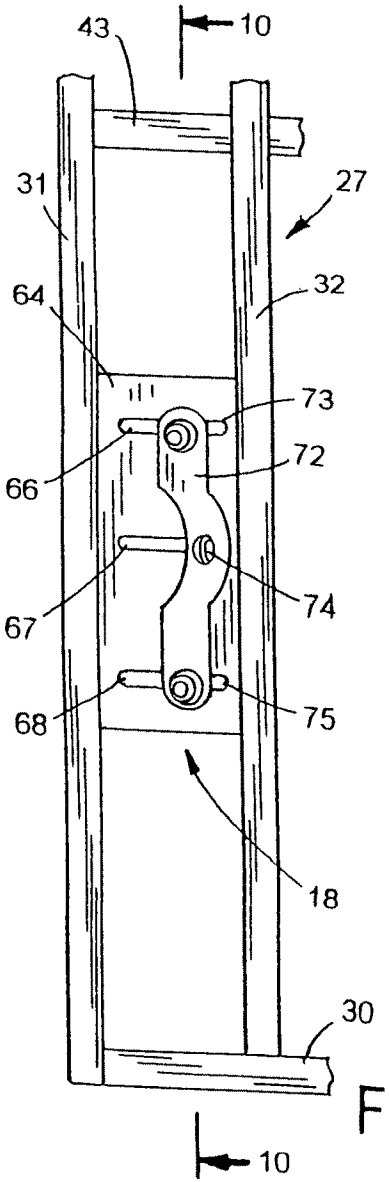
FIG. 9 is an elevational view of a lower corner section of the door frame of FIG. 2.
Figure 11:
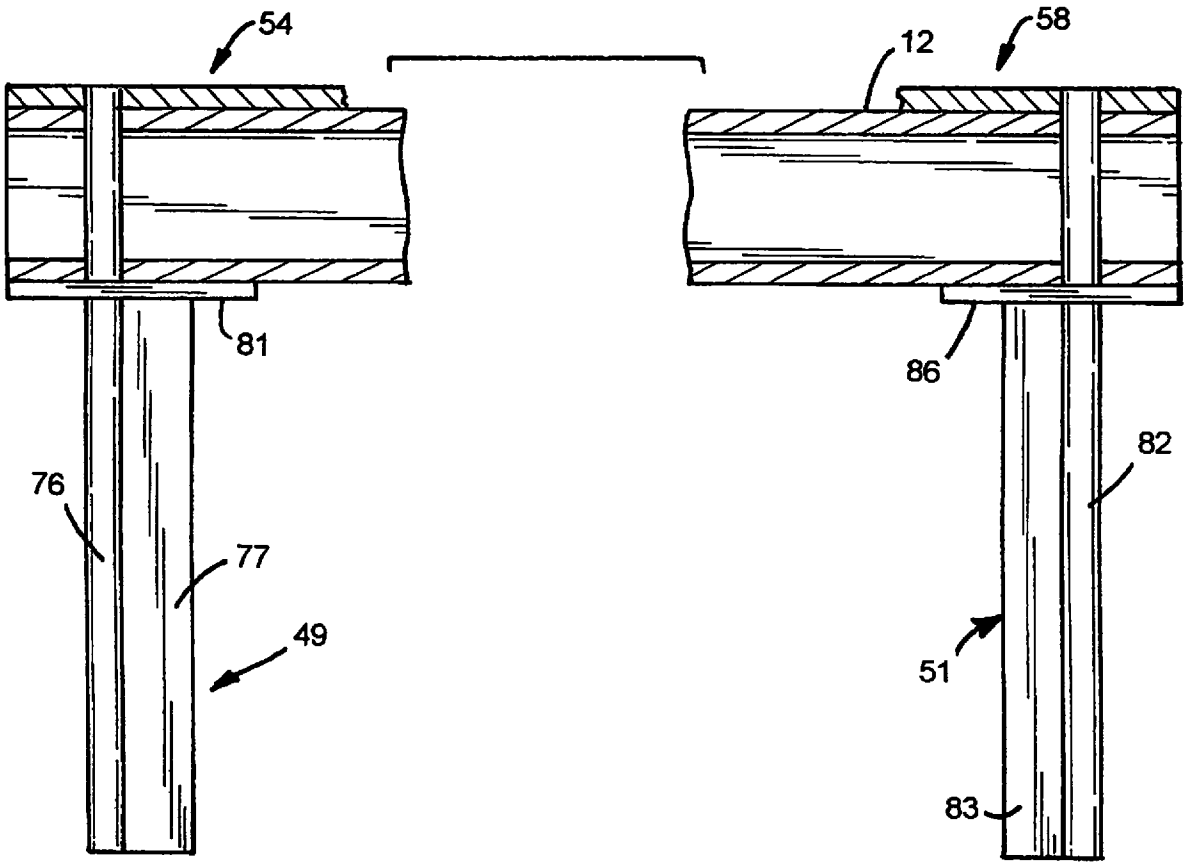
FIG. 11 is an enlarged foreshortened sectional view taken along the line 11-11 of FIG. 5.

Mount 18 for hydraulic cylinder 16, shown in FIGS. 9 and 10, comprises a flat plate 64 located between upright end members 31 and 32 of door frame 27. Plate 64 is secured with welds to end members 31 and 32 whereby the forces subjected to mount 18 are imparted to both end members 31 and 32 of door frame 27. Plate 64 has three horizontal slots 66, 67 and 68. A flat member 69 secured to a rearward extended arm 71 contacts the rear side of plate 64. The rod end of hydraulic cylinder 16 is pivotally connected to arm 71. A bar 72 is located adjacent the front side of plate 64. A plurality of fasteners 73, 74, and 75, shown as nut and bolt assemblies, extended through slots 66, 67 and 68 clamp member 69 and bar 72 to plate 64 in an adjusted horizontal location on plate 64. The horizontal location of member 69 and arm 71 relative to door frame 27 locates the rod end of hydraulic cylinder 16 in an effective selected position relative to door frame 27. Mount 19 secured to members 33 and 34 of door frame 27 has the same structure and horizontal adjustment as mount 18. Mount 19 is pivotally connected to the rod end of hydraulic cylinder 17.

As shown in FIGS. 11 to 17, splice assembly 49 has a downward extended body 76 comprising a flat member having an upper end extended into header 12. Body 76 extends downward from the left end of header 12. A pair of parallel ribs or flanges 77 and 78 are secured to the inside of body 76. Ribs 77 and 78 are secured with welds to body 76. Ribs 77 and 78 can be integral with body 76 whereby body 76 and ribs 77 and 78 are a one-piece member. A horizontal plate 81 joined to the upper ends of ribs 77 and 78 is located in surface engagement with and secured to the bottom of header 12 retains splice assembly 49 in a downward 90 degree relationship with respect to header 12. A plurality of nuts 87, 88 and 89 are mounted on body 76 between ribs 77 and 78. Splice assembly 51 has a body 82 extended downward from the right end of header 12. A pair of parallel ribs 83 and 84 are secured with welds to the inside of body 82. Ribs 83 and 84 can be integral with body 82. A horizontal plate 86 joined to the bottom of header 12 and located in surface engagement with the top end of column 14 retains splice assembly 51 in a downward 90 degree relationship with respect to header 12.

Figure 19:
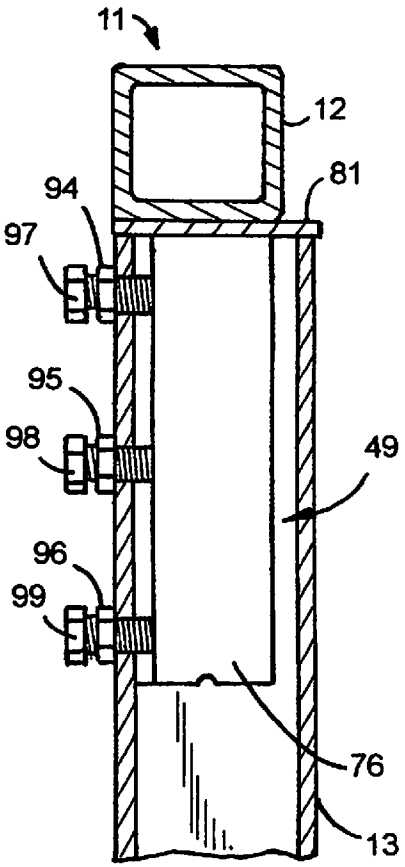
FIG. 19 is a sectional view taken along the line 19-19 of FIG. 18.
Figure 18:
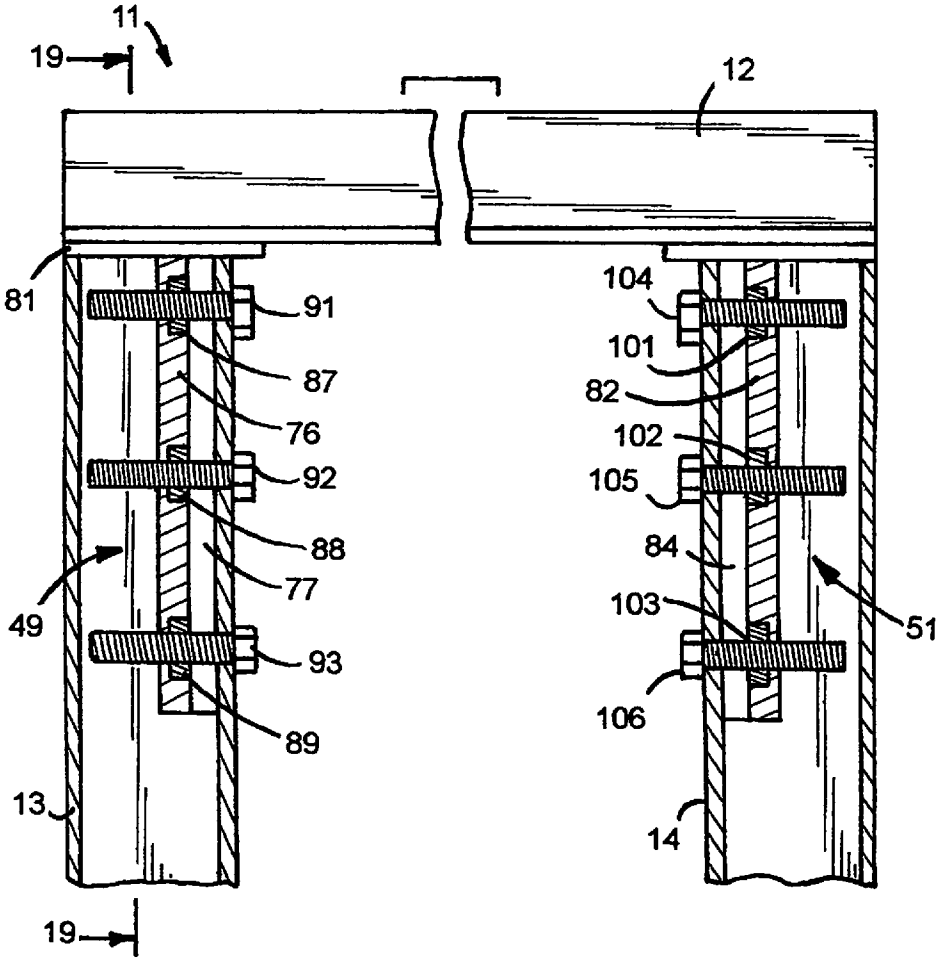
FIG. 18 is an enlarged foreshortened front elevational view, partly sectioned, of the frame assembly of FIG. 3.
Figure 20:
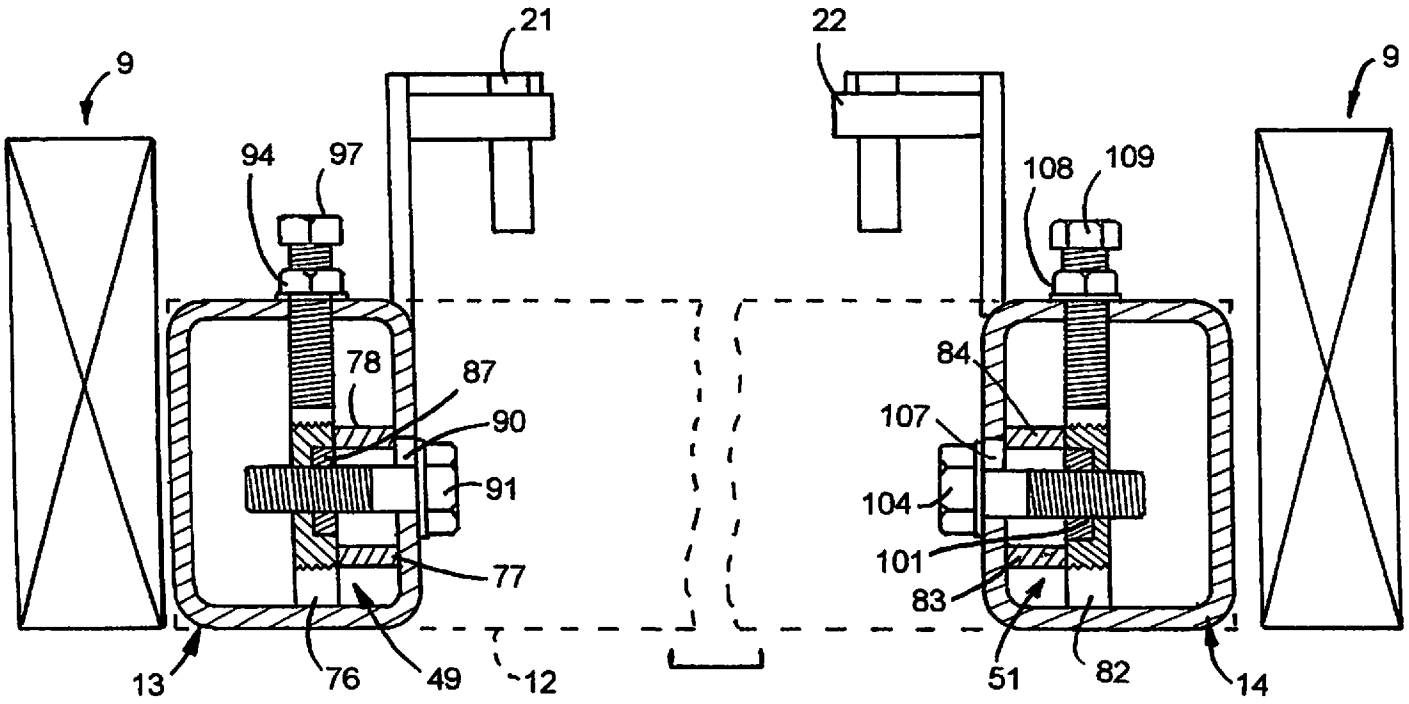
FIG. 20 is an enlarged foreshortened sectional view taken along the line 20-20 of FIG. 3.

The assembly of columns 13 and 14 or header 12 with splice assemblies 49 and 51 is illustrated in FIGS. 18, 19 and 20. Splice assembly 49 extends downward into the upper end of tubular column 13. Bolts 91, 92 and 93 extended through elongated holes 90 in column 13 are threaded into nuts 87, 88 and 89 to secure splice assembly 49 to column 13 and longitudinally locate column 13 on header 12. As shown in FIG. 19, nuts 94, 95 and 96 secured with welds to the rear side wall of column 13 accommodate bolts 97, 98 and 99. Bolts 97, 98 and 99 extend into the tubular column 13 and engage body 76 and laterally locate body 76 within column 13. Bolts 91, 92, 93 and bolts 97, 98 and 99 cooperate with body 76 of splice assembly 49 to maintain column 13 in a 90 degree relationship with header 12. Returning to FIG. 18, body 82 of splice assembly 51 supports nuts 101, 102 and 103. Bolts 104, 105 and 106 extended through elongated hubs in column 14 are threaded into nuts 101, 102 and 103 to secure splice assembly to header 12 and longitudinally locate column 14 on header 12. As shown in FIG. 20, a nut 108 secured to the back wall of column 14 accommodate a bolt 109. Bolt 109 extended into column 14 contacts body 82 to laterally locate column 14 relative to splice assembly 51.

Figure 21:
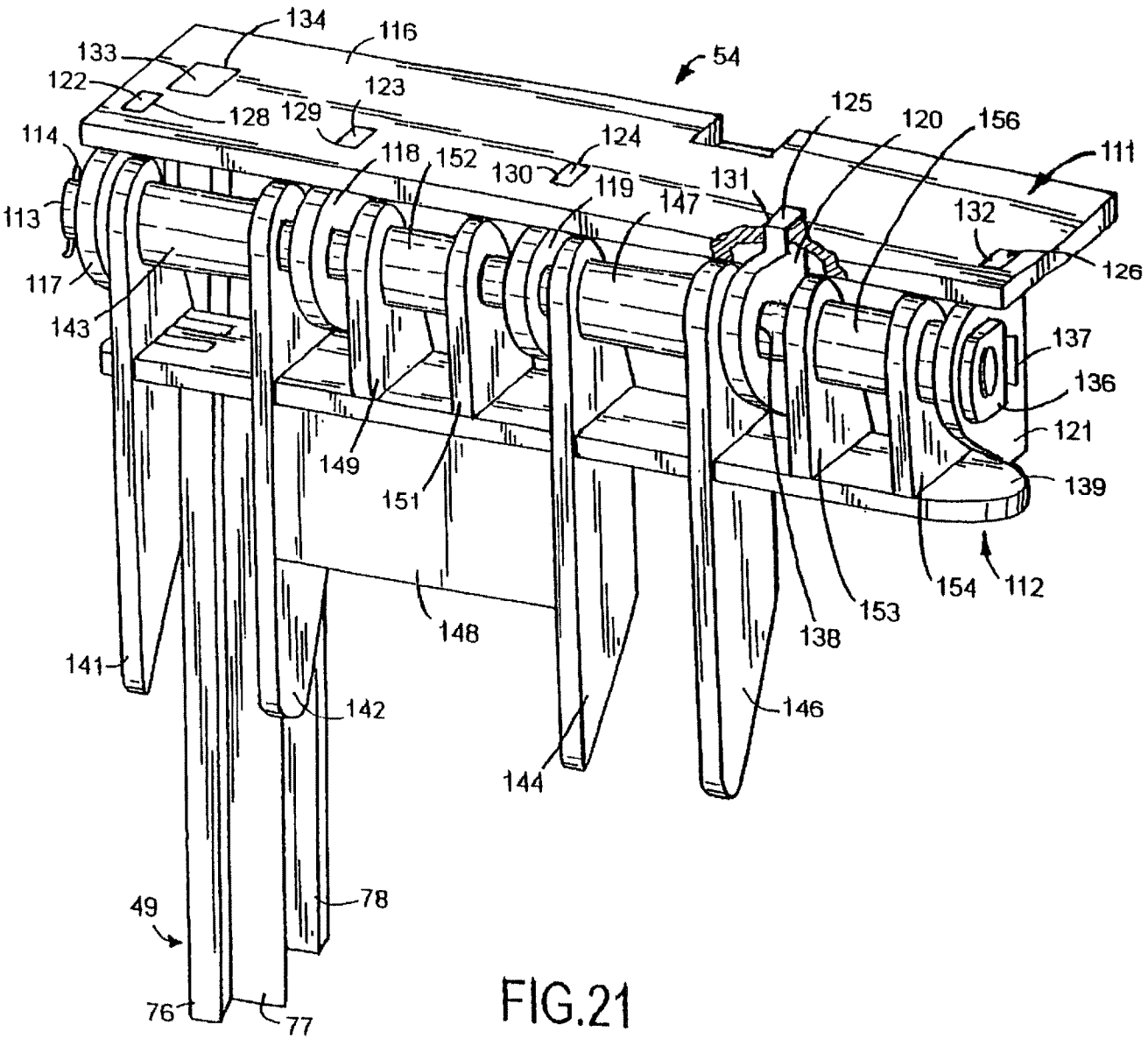
FIG. 21 is a perspective view of the left hinge connecting the door frame to the frame assembly.
Figure 22:
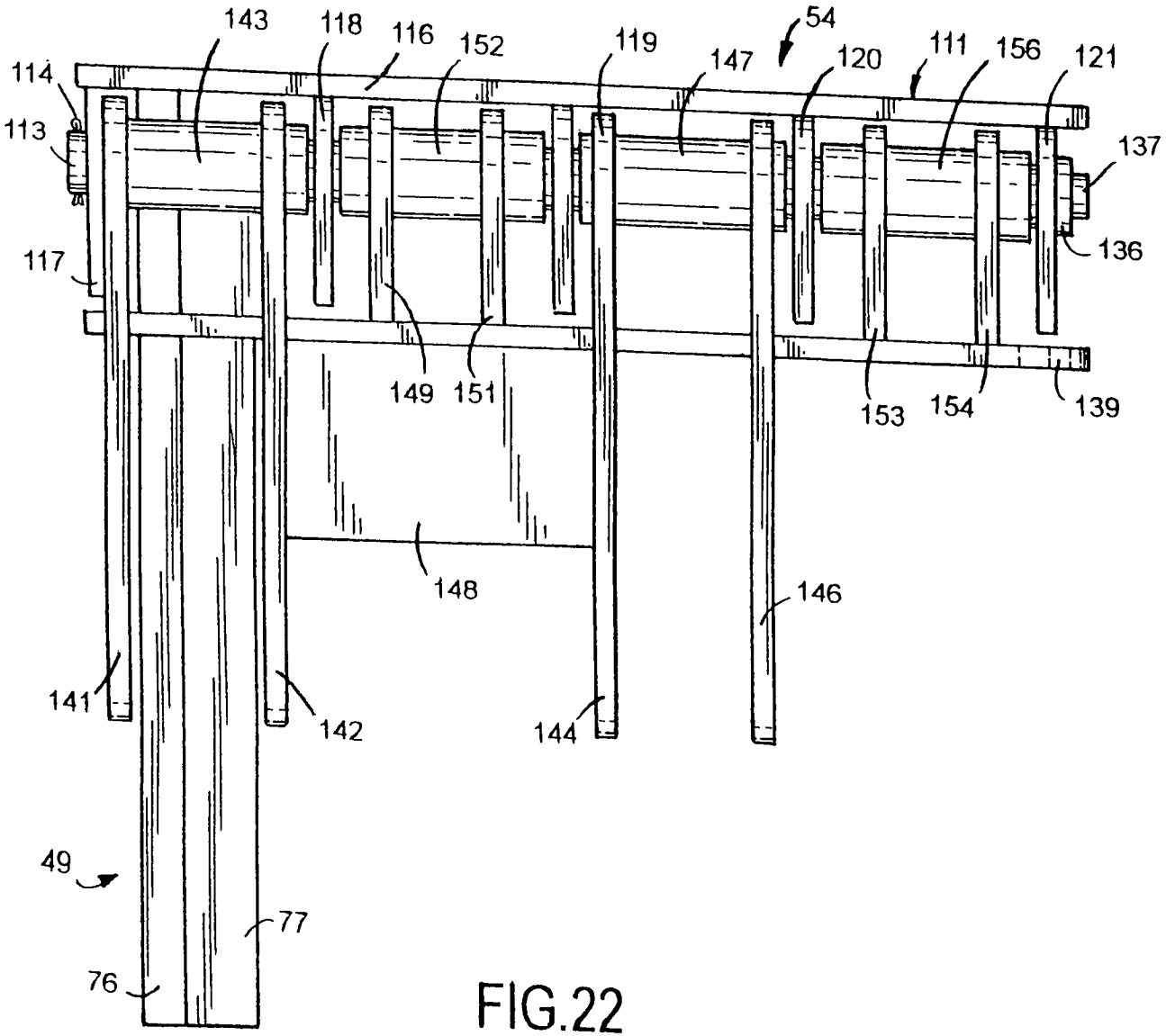
FIG. 22 is a front elevational view of FIG. 21.
Figure 25:
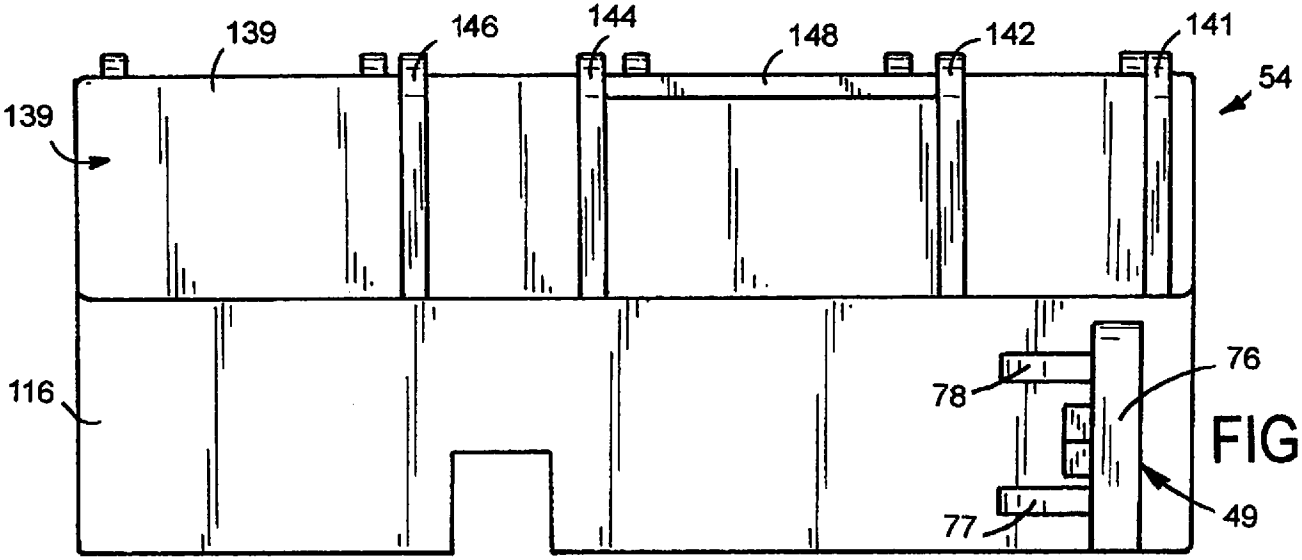
FIG. 25 is a bottom plan view of FIG. 21.
Figure 27:
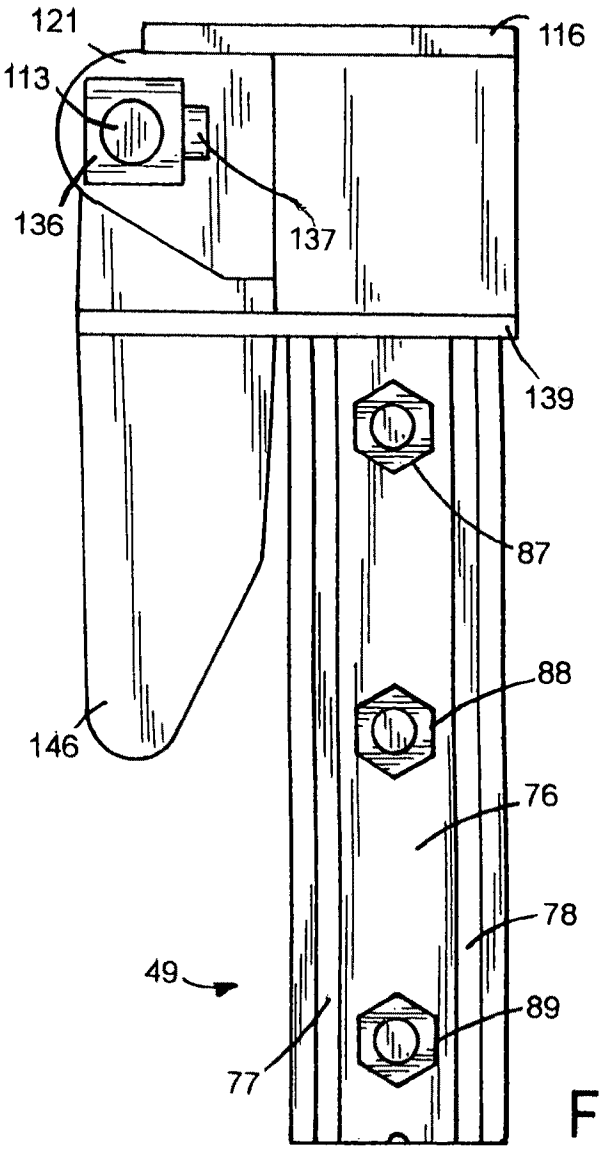
FIG. 27 is a right side elevational view of FIG. 21.
Figure 26:
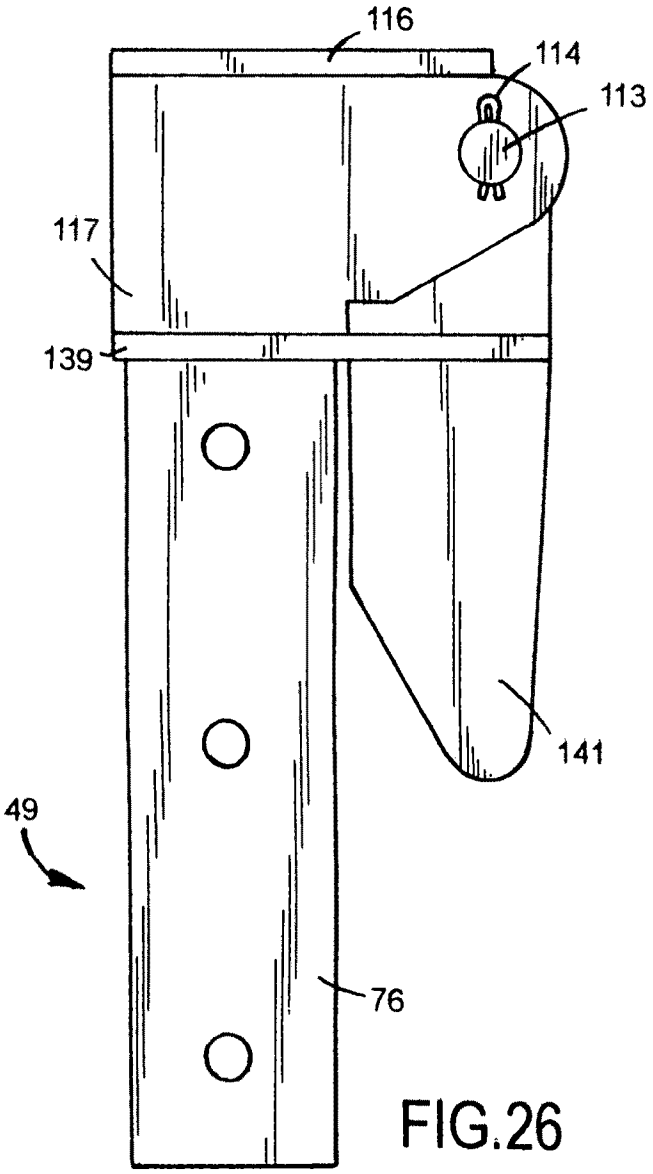
FIG. 26 is a left side elevational view of FIG. 21.
Figure 28:
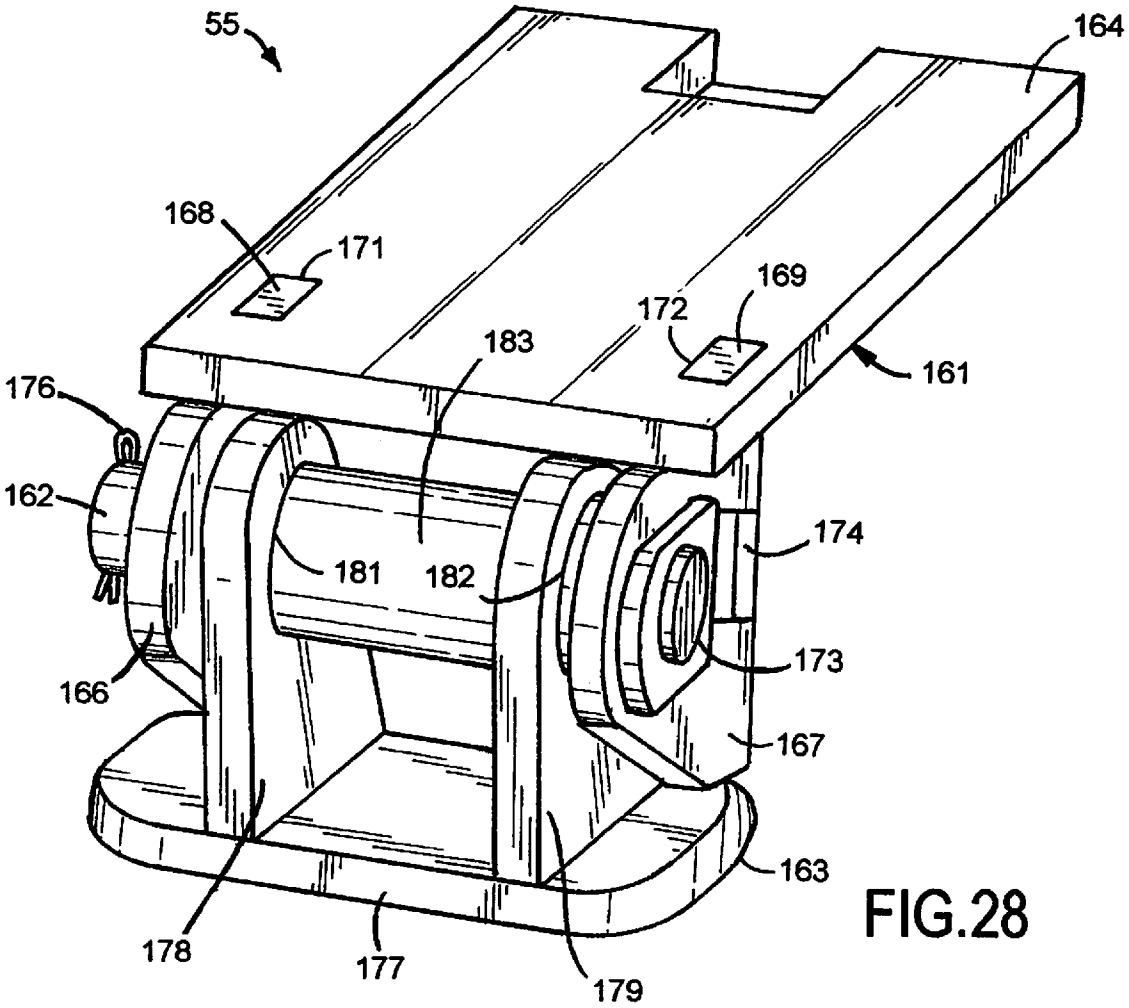
FIG. 28 is a perspective view of the center hinge connecting the door frame to the frame assembly.
Figure 29:
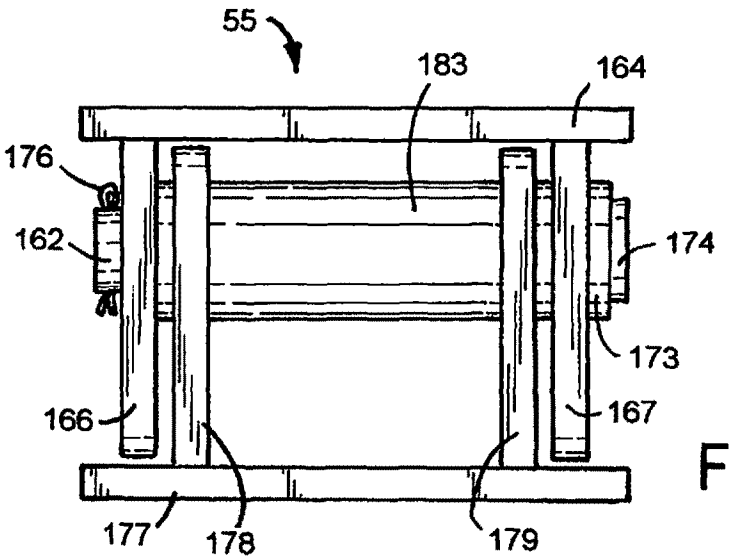
FIG. 29 is a front elevational view of FIG. 28.

A first hinge 54, shown in FIGS. 21 to 27, pivotally connects the left end of header 12 to the left upper corner of door frame 11. Hinge 54 has a frame assembly unit 111 and a door frame unit 112 pivotally connected with a pin or cylindrical rod 113. Frame assembly unit 111 has a top member 116, shown as a flat horizontal plate located on and secured to the top of header 12. A plurality of supports 117, 118, 119, 120 and 121 for rod 113 extend downwardly from the bottom of member 116. Supports 117-121 are flat metal plates having upwardly directed projections or ears 122, 123, 124, 125 and 126 located in rectangular holes 128, 129, 130, 131 and 132 in member 116. As shown in FIGS. 21 and 25, holes 128-132 are rectangular openings longitudinally spaced along the length of member 116 that determine the locations of supports 117-121 on member 116. Welds secure supports 117-121 to the bottom of member 116. Body 76 of splice assembly 49 has an upright projection or ear 133 located in a rectangular hole 134 in member 116 located adjacent hole 128. The top end of splice assembly 49 is secured with welds to plate 81. Plate 81 is secured with welds to header 12.

Returning to FIGS. 21 and 27, a block or square member 136 is secured to the right end of pin 113. Block 136 is located adjacent the outside surface of support 121. A stop 137 secured to support 121 is located adjacent block 136 functions to prevent block 136 and pin 113 from rotating on supports 117-121. A retainer 114, shown as a cotter key, on the left end of pin 113 and block 136 limit longitudinal shifting of pin 113 relative to supports 117-121. Pin 113 extends through aligned openings in support 117-121. Support 120 has a cylindrical opening 138 for pin 113. Supports 117, 118, 119 and 121 have cylindrical openings for pin 113 that correspond to opening 138 in support 120. Block 136 and stop 137 prevent pin 113 from rotating on supports 117-121 thereby precluding wear on and cutting of pin 113.

Hinge 54 has a second or door frame unit 112 pivotally connected to pin 113 to allow door frame 27 to move between its upright closed position and horizontal open position. Door frame unit 112 has a horizontal member or plate 139 secured to the top member 29 of door frame 27. A first pair of upright members 141 and 142 mounted on plate 139 has lower sections secured to opposite sides of door frame end member 31 and upper sections located adjacent supports 117 and 118. A tubular sleeve 143 secured to the upper sections of members 141 and 142 surround pin 113. A second pair of upright members 144 and 146 mounted on plate 139 has lower sections secured to opposite sides of door frame end member 32 and upper sections located adjacent supports 119 and 120. A tubular sleeve 143 secured to the upper sections of members 141 and 142 surround pin 113. The upright members 141, 142 and 144, 146 reinforce and add strength to the connection of door frame end members 31 and 32 to hinge 54 and door frame header 29. A spacer bar 148 located between and secured to members 142 and 144 and plate 139 maintains the lateral space between members 142 and 144.

Figure 23:
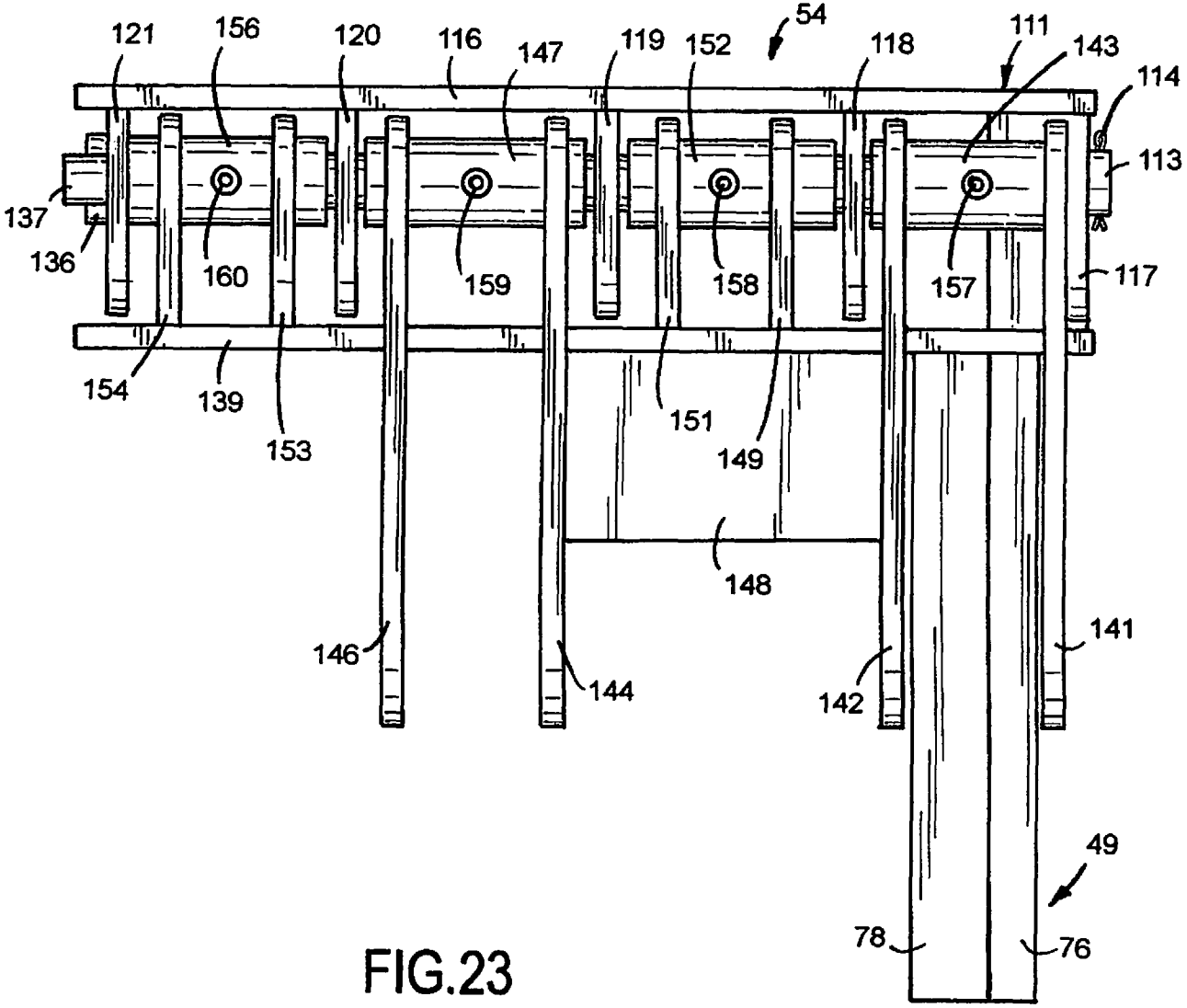
FIG. 23 is a rear elevational view of FIG. 21.
Figure 24:
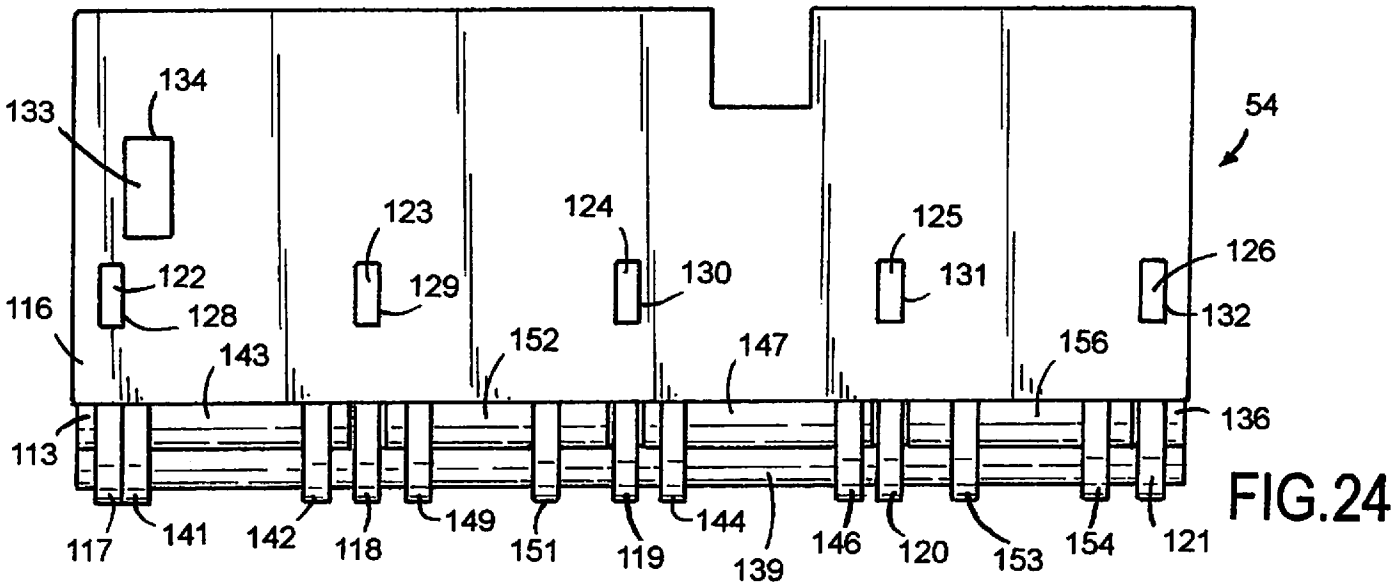
FIG. 24 is a top plan view of FIG. 21.

A first pair of upright arms 149 and 151 secured to plate 139 are located between supports 118 and 119. A tubular sleeve 152 secured with welds to arms 149 and 151 accommodates pin 113. A second pair of upright arms 153 and 154 secured to plate 139 is located between supports 120 and 121. Opposite ends of a sleeve 156 extend through holes in arms 153 and 154. Welds secure sleeve 156 to arms 153 and 154. Sleeve 156 has a cylindrical passage accommodating pin 113. Sleeves 143, 147, 152 and 156 are rotatably mounted on pin 113 whereby pin 113 supports door frame 27 on header 12 along with hinges 55, 56, 57 and 58. As shown in FIG. 23, grease fittings 157, 158, 159 and 160 mounted on the back of sleeves 143, 152, 147 and 156 are used to introduce grease into sleeves to lubricate the interface between sleeves 143, 152, 147 and 156 and pin 113. Grease fittings 157-160 extend downward when door 10 is in its open position whereby the grease fittings are accessible to a person for applying grease to the grease fittings.

Returning to FIG. 2, second hinges 55, 56 and 57 secured to frame assembly 11 and door frame 27 are located between end hinges 54 and 58. The number of hinges between end hinges 54 and 58 can vary between one or more hinges according to the width of door 10. Hinges 55, 56 and 57 have identical structures and functions that support door frame 27 on header 12 and allow door frame 27 to pivotally move between an upright closed position to a generally horizontal open position. The following description of hinge 55, shown in FIGS. 28 to 34, is applicable to hinges 56 and 57.

Proceeding to FIGS. 28 to 34, second hinge 55 has a frame assembly unit 161 pivotally connected with a pin 162 to a door frame unit 163. Frame assembly unit 161 has a flat member or plate 164. A pair of supports 166 and 167 is secured with welds to the bottom of plate 164. Upright projections or ears 168 and 169 on supports 166 and 167 are located in rectangular holes or openings 171 and 172 in plate 164. Ears 168 and 169 located in openings 171 and 172 laterally position supports 166 and 167 on plate 164. Plate 164 and supports 166 and 167 are secured with welds to header 12 as shown in FIG. 5. A block 173 located adjacent support 167 is secured to pin 162. A stop 174 attached to support 167 is located in engagement with block 173 to prevent block 173 and pin 162 from rotating on supports 166 and 167. A retainer 176, shown as a cotter key, on the end of pin 162 opposite block 173 cooperates with block 173 to limit axial movement of pin 162 relative to supports 166 and 167.

Figure 30:
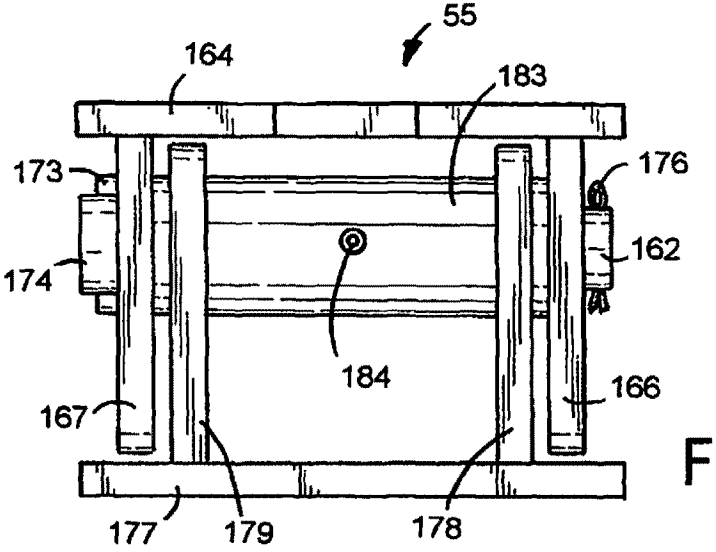
FIG. 30 is a rear elevational view of FIG. 28.
Figure 31:
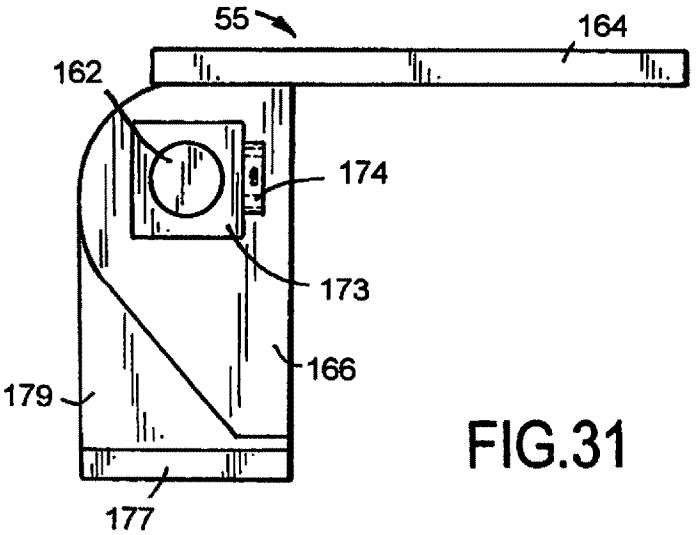
FIG. 31 is a right side elevational view of FIG. 28.
Figure 32:
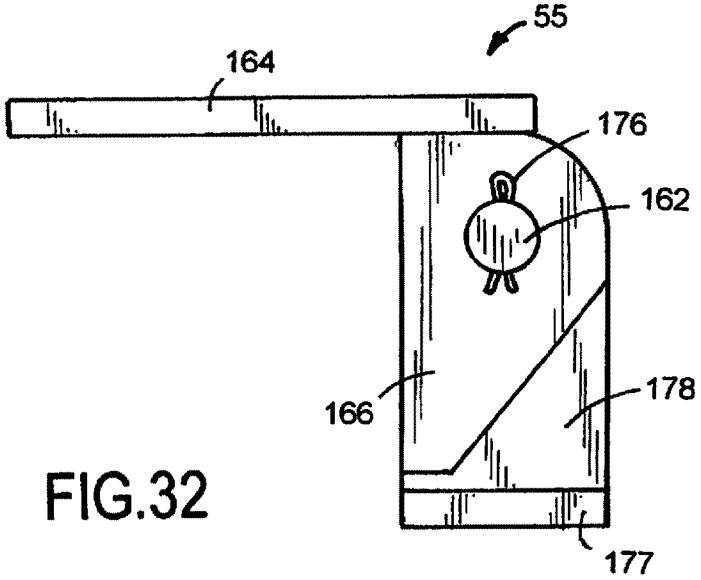
FIG. 32 is a left side elevational view of FIG. 28.
Figure 34:
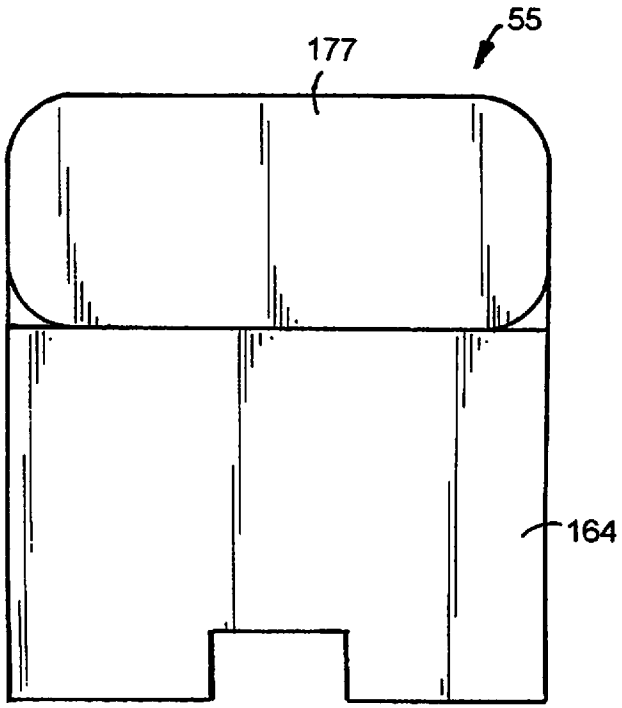
FIG. 34 is a bottom plan view of FIG. 28.
Figure 33:
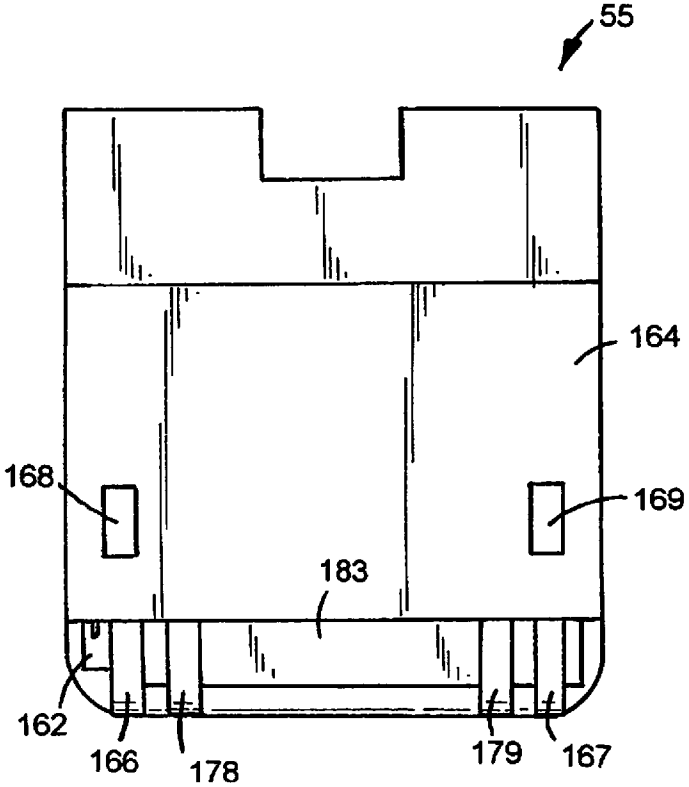
FIG. 33 is a top plan view of FIG. 28.
Figure 35:
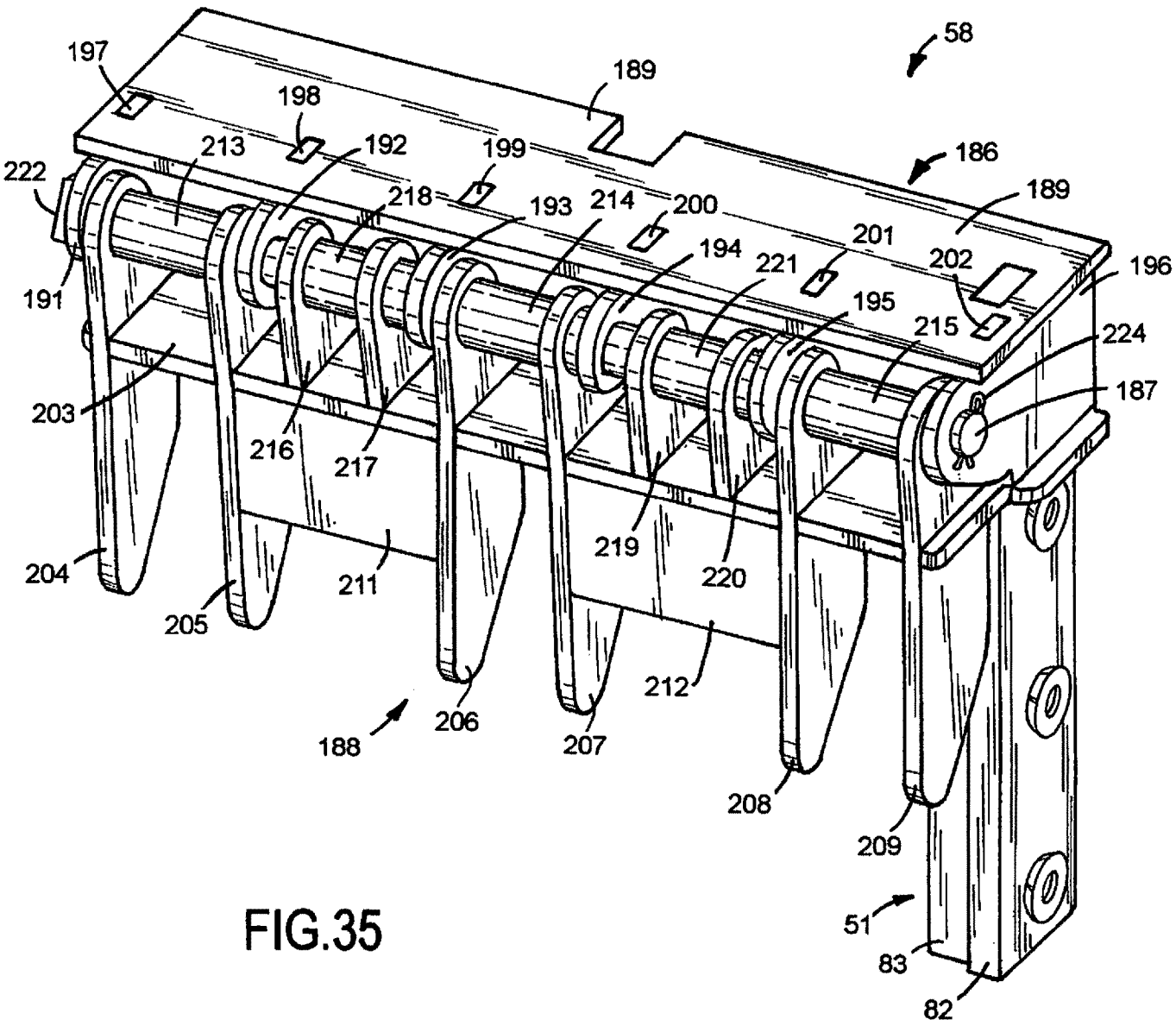
FIG. 35 is a front perspective view of the right hinge connecting the door frame to the frame assembly.
Figure 37:
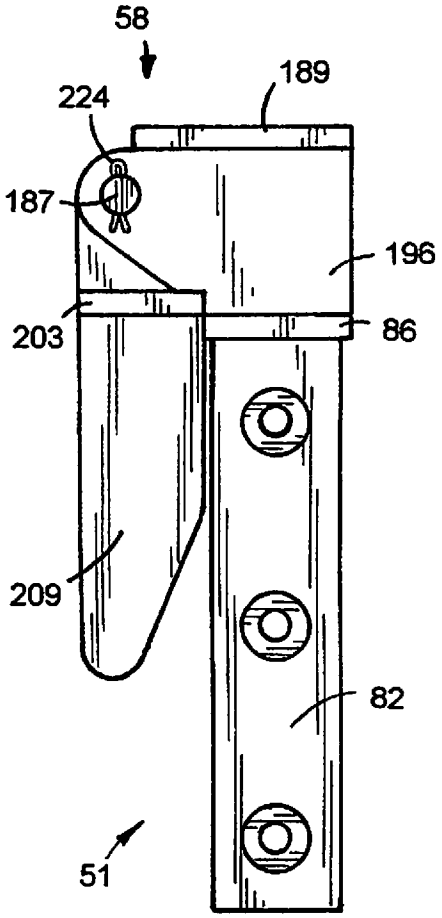
FIG. 37 is a right side elevational view of FIG. 35.
Figure 36:
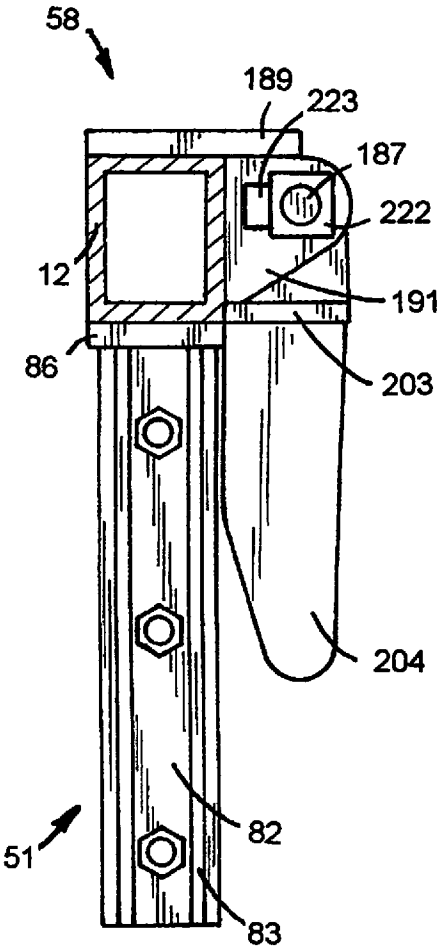
FIG. 36 is a left side elevational view of FIG. 35.
Figure 38:
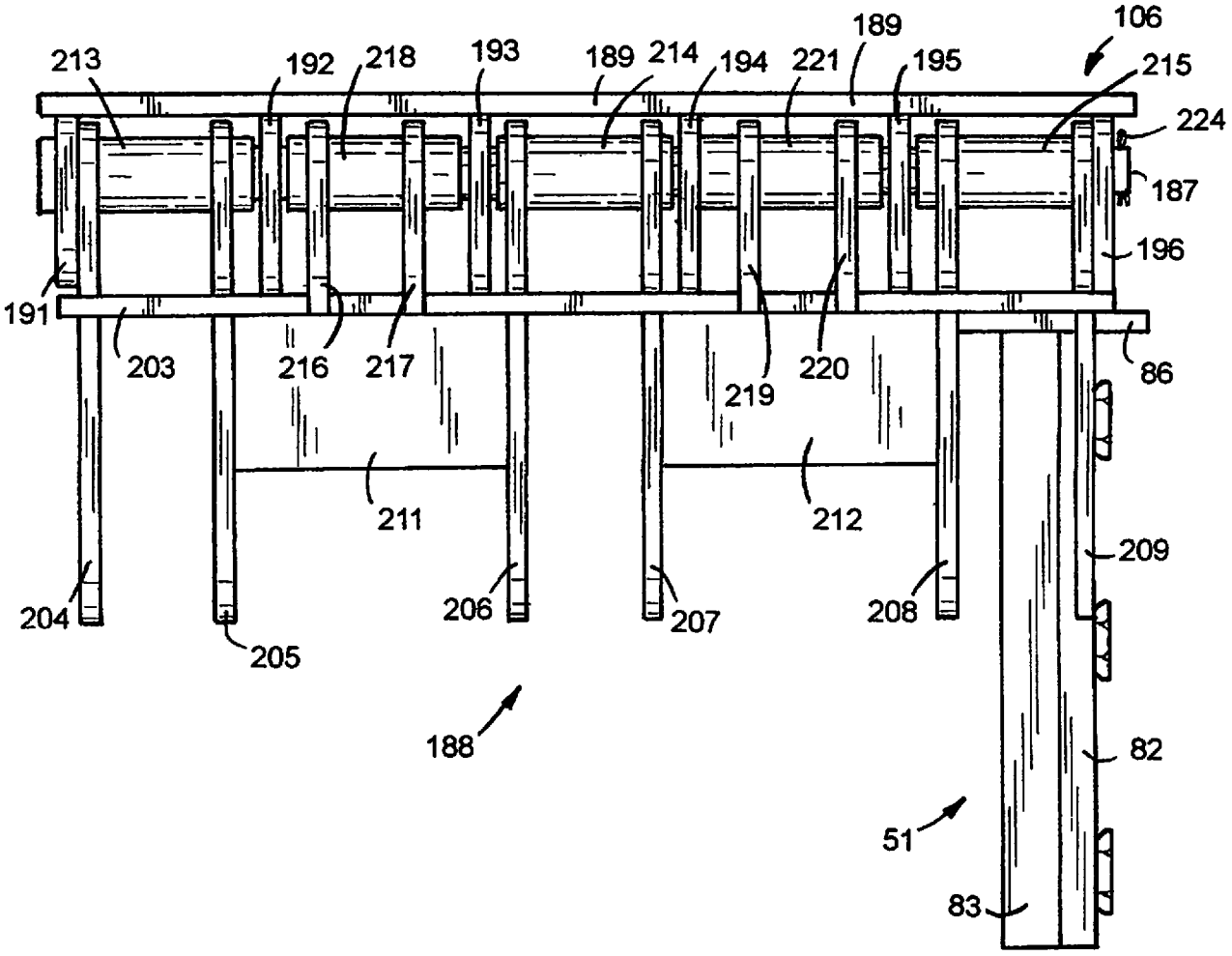
FIG. 38 is a front elevational view of FIG. 35.

Door frame unit 163 has a flat member or plate 163 secured with welds to the top or header member 29 of door frame 27. A pair of upright arms 178 and 179 secured to plate 177 are located between supports 166 and 167. Arms 178 and 179 have cylindrical holes or openings 181 and 182 accommodating a cylindrical tubular sleeve 183. Pin 162 extends through tubular sleeve 182 thereby rotatably mounting sleeve 182 on pin 162 and supporting door frame 27 on header 12. As shown in FIG. 30, a grease fitting 184 is mounted on the back side of sleeve 183. A conventional grease gun is used with grease fitting 184 to introduce grease to the interface between pin 162 and sleeve 183.

A third right hinge 58, shown in FIGS. 35 to 41, has a frame assembly unit 186 connected with a horizontal pin or rod 187 to a door frame unit 188. Door frame unit 188 is secured to door frame 27, as shown in FIG. 2. Frame assembly unit 186 includes a horizontal member or plate 189 and downwardly directed supports 191, 192, 193, 194, 195 and 196 secured with welds to the bottom of plate 189. Supports 191 to 196 have upward directed projections or ears 197, 198 199, 200, 201 located in longitudinally separated openings in plate 187. The ears 197 to 201 located in the openings in plate 189 laterally space adjacent supports along the length of plate 189.

Figure 39:
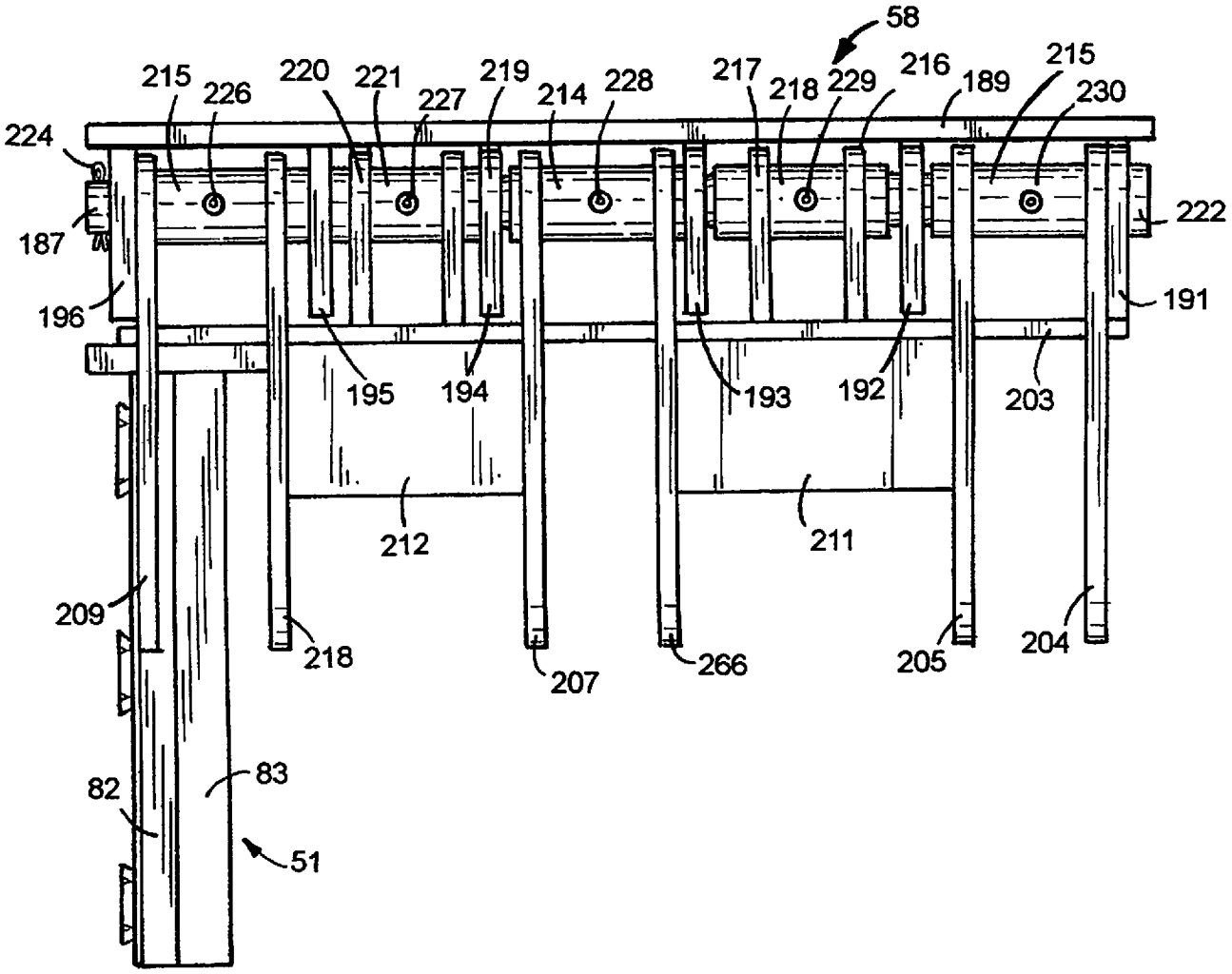
FIG. 39 is a rear elevational view of FIG. 35.
Figure 40:
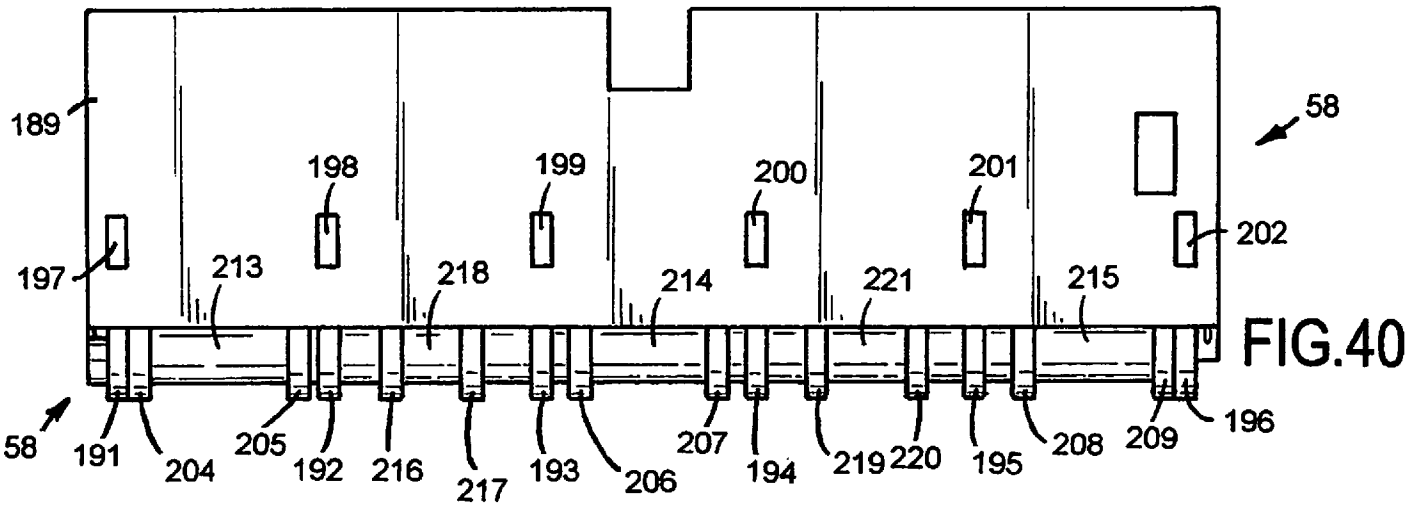
FIG. 40 is a top plan view of FIG. 35.
Figure 41:
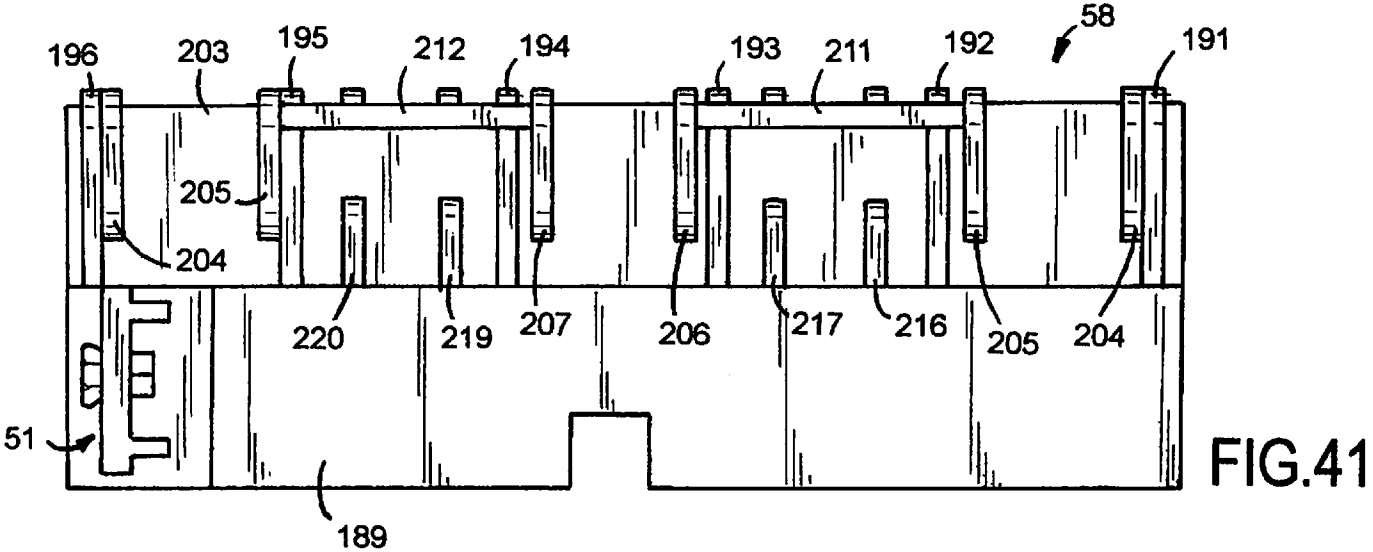
FIG. 41 is a bottom plan view of FIG. 35.

Door frame unit 188 includes a flat horizontal member or plate 203. A first pair of upright members 204 and 205 are attached to the left or inner end of plate 203. A second pair of upright members 206 and 207 are attached to a middle section of plate 203. A third pair of upright members 208 and 209 are attached to the right or outer end of plate 203. A flat first bar 211 located between upright members 205 and 206 is secured with welds to plate 203 and upright members 205 and 206. Bar 211 laterally spaces upright members 205 and 206 and reinforces plate 203 and upright members 205 and 206. A second bar 212 located between upright members 207 and 208 is secured with welds to plate 203 and upright members 207 and 208. Bar 212 laterally spaces upright members 207 and 208 and reinforces plate 203 and upright members 208 and 209. Sleeves 213, 214 and 215 are located between the upper sections of upright members 204, 205 and 206, 207, and 208, 209. Sleeves 213, 214 and 215 are tubular members having cylindrical passages accommodating pin 187. Opposite ends of sleeves 213, 214 and 215 are secured to adjacent upright members. A first pair of upright arms 216 and 217 are secured with welds to plate 203 between supports 192 and 193. A sleeve 218 secured to arms 216 and 217 accommodates pin 187. A second pair of upright arms 219 and 220 are secured to plate 203 between supports 194 and 195. A sleeve 221 secured to arms 219 and 220 accommodate pin 187. Sleeves 218 and 221 are tubular members having cylindrical passages accommodating pin 187. Pin 187 is an elongated cylindrical member that extends through supports 191 to 196, and sleeves 213, 214, 215, 218 and 221 to pivotally connect frame assembly unit 186 to door frame unit 188. A block 223, shown in FIG. 36, secured to the end of pin 181 contacts a stop 223 that prevents rotation of pin 187 relative to supports 191 to 196 and sleeves 213, 214, 215, 218 and 221. Sleeves 213, 214, 215, 218 and 221 rotate on fixed pin 187 during the opening and closing movements of door 10. A retainer 224, shown as a cotter key, on the end of pin opposite block 222, shown in FIGS. 35, 37, 38 and 39, limits axial movement of pin 187 relative to supports 191 to 196 and sleeves 213, 214, 215, 218 and 221. As shown in FIG. 39, grease fittings 226, 227, 218, 229 and 230 are attached to sleeves 214, 221, 214, 218 and 215. Grease fittings 226 to 230 accommodate a conventional grease gun used to introduce grease to the interface between sleeves 213, 214, 215, 218 and 221 and pin 187. Grease fittings 226 to 230 extend downward when door 10 is in its open position whereby all of grease fittings 226 to 230 are accessible to a person for applying grease to the grease fittings.

Returning to FIG. 2, members 141 and 142 of hinge 54 are secured with welds to opposite sides of end door frame member 31 and member 144 and 146 are secured with welds to opposite sides of door frame member 32. Plate 139 is secured with welds to the top door frame header 29. Hinge member 141, 142, 144 and 146 along with plate 139 are the left corner structure that connects door frame members 31 and 32 to door header 29. Hinges 55, 56 and 57 are vertically aligned with door frame members 36, 37 and 38. The vertical orientation of hinges 55, 56 and 57 relative to door frame members 36, 37 and 38 reduces the door weight bending and twisting forces on header 12 and frame member 29. Members 204 and 205 of hinge 58 are secured with welds to opposite sides of door member 35. Members 206 and 207 are secured with welds to opposite sides of door member 35. Members 208 and 209 are secured with welds to opposite sides of end door member 33. The hinge members 204, 205, 206, 207, 208 and 209 secured to door members 35, 34 and 33 are the right corner structure that connects the door frame 27 to frame assembly header 12.

Proceeding to FIGS. 5, 6, 18 and 20, columns 13 and 14 are inserted into splice assemblies 49 and 51 secured to opposite ends of header 12 and hinges 54 and 58. A plurality of bolts 91, 92 and 93 extended through holes in column 13 are threaded into nuts 87, 88 and 89. Bolts 57, 58 and 59 are turned tight to secure column 13 to splice assembly 49 and move the inner wall of column 13 into firm engagement with ribs 87 and 88. The outer wall of column 13 is located in vertical alignment with the first outer end of header 12. The outer surface of the wall of column 13 is located in the same or common vertical plane as the first end of header 12. The first end of header 12 and column 13 are located in close relationship with the adjacent surface of building wall 9.

As shown in FIGS. 19 and 20, bolts 97, 98 and 99 threaded through nuts 94, 95 and 96 engage a side of body 76. Nuts 94, 95 and 96 are secured by welds adjacent holes in column 13. Bolts 97, 98 and 99 are turned to hold body 82 in column 13. The outside surface of the wall of column 14 is vertically aligned with the outside front surface of header 12. The outside surface of the wall of column 14 and the outside front surface of header 12 are located in the same or common vertical plane.

Splice assembly 51, shown in FIGS. 18 and 20, secured to column 14 with bolts 104, 105 and 106 and nuts 101, 102 and 103 retains column 14 in a vertical position relative to header 12. Column 14 is prevented from moving laterally and vertically relative to header 12. Bolts 104, 105 and 106 and 109 also permit adjustment of column 14 in two directions relative to the end of header 12.

The foregoing drawing and description of the frame assembly and hinges for an overhead door is one embodiment of the invention. Persons skilled in the art of overhead doors can make changes and modifications in structures and materials of the door, frame assembly and hinges without departing from the door, frame assembly and hinges defined in the claims.

The invention claimed is:

1. A combined door and frame assembly comprising:

a door including a door frame having a top horizontal member, first upright members secured to the horizontal member and second upright members secured to the horizontal member, a frame assembly for supporting the door for pivotal movement between a door open position and a door closed position, said frame assembly including a generally horizontal header, a first upright column and a second upright column, said header having a first end and a second end opposite the first end, the first upright column having an upper tubular end located adjacent the first end of the header, the second upright column having an upper tubular end located adjacent the second end of the header, a first splice assembly secured to the first end of the header, said first splice assembly being located in telescope relationship with the upper tubular end of the first upright column, the first splice assembly includes a generally flat upright first body having an upright first wall, the upright first body having a first edge and a second edge on opposite sides of the first body, said first and second edges being generally perpendicular to said upright first wall of the upright first body, a first member operatively connected to the first upright column and engageable with the first edge of the upright first body to hold the second edge of the upright first body in engagement with the first upright column, a first pair of upright ribs secured to the upright first wall of the upright first body, the first pair of upright ribs having outer ends spaced away from the upright first wall of the upright first body, first fasteners securing the first splice assembly to the upper tubular end of the first upright column, the first fasteners being operatively connected to the upright first body and the first upright column to hold the outer ends of the first pair of upright ribs in engagement with the first upright column, a second splice assembly secured to the second end of the header, said second splice assembly being located in telescope relationship with the upper tubular end of the second upright column, the second splice assembly includes a generally flat upright second body having an upright second wall, a second pair of upright ribs secured to the upright second wall, the second pair of upright ribs having outer ends spaced from the upright second wall, second fasteners securing the second splice assembly to the upper tubular end of the second upright column, the second fasteners being operatively connected to the upright second body and the second upright column to hold the outer ends of the second pair of upright ribs in engagement with the second upright column, the upright second body having a third edge and a fourth edge opposite the third edge, said third and fourth edges being generally perpendicular to said upright second wall of the upright second body, a second member operatively connected to the second upright column and engageable with the third edge of the upright second body to hold the fourth edge of the upright second body in engagement with the second upright column, a plurality of hinges supporting and pivotally connecting the door frame to the header for pivotal movement of the door between the door open position and the door closed position, at least one of said hinges includes a horizontal hinge member secured to the header of the frame assembly, supports secured to the horizontal hinge member, arms secured to one of the first and second upright members of the door frame, a tubular sleeve secured to the arms, and a pin extended through the supports, the arms and the tubular sleeve to pivotally support the door frame on the header to allow the door to move between the door open position and the door closed position, a first linear actuator operatively connected to the first upright column and the door frame, and a second linear actuator operatively connected to the second upright column and the door frame, the first and second linear actuators being operable to move the door relative to the frame assembly between the door open position and the door closed position.

2. The combined door and frame assembly of claim 1 wherein:

the first fasteners include first nuts secured to the upright first body, and threaded first bolts cooperating with the first nuts, the second fasteners include second nuts secured to the upright second body, and threaded second bolts cooperating with the second nuts.

3. The combined door and frame assembly of claim 1 wherein:

the first upright members of the door frame include a pair of first upright members, the second upright members of the door frame include a pair of second upright members, the arms include a plurality of vertical first arms and a plurality of vertical second arms, the plurality of hinges include a first hinge located adjacent to the first splice assembly and secured to the pair of first upright members of the door frame, the plurality of hinges including a second hinge located adjacent to the second splice assembly and secured to the pair of second upright members of the door frame.

4. The combined door and frame assembly of claim 1 including:

a mount secured to the door frame and the first linear actuator, said mount including a plate secured to the first upright members of the door frame, said plate having a first side, a second side and plurality of horizontal slots extending through the plate, a flat member located in contact with the first side of the plate, the first linear actuator being operatively connected to the flat member, a bar located in contact with the second side of the plate, and fasteners extending through the slots in the plate for connecting the flat member and the bar and clamping the flat member and the bar on the plate.

5. The combined door and frame assembly of claim 1 including:

a block secured to the pin, and a stop secured to one of the supports, said stop being engageable with the block to prevent rotation of the pin relative to the arms and tubular sleeve.

6. The combined door and frame assembly of claim 1 wherein:

the plurality of hinges comprise a first hinge located in vertical alignment with the first upright members and a second hinge located in vertical alignment with the second upright members.

7. The combined door and frame assembly of claim 1 including:

a member joined to the pin, and a stop on one of the supports, said stop being engageable with the member joined to the pin to prevent rotation of the pin relative to the arms and the tubular sleeve.

8. The combined door and frame assembly of claim 1 including:

a first mount secured to the door frame and the first linear actuator, a second mount secured to the door frame and the second linear actuator, the first mount includes a first plate secured to the first upright members of the door frame, a first flat member located adjacent the first plate, the first linear actuator being operatively connected to the first flat member, and a first fastener connecting the first flat member to the first plate in a selected location on the first plate, the second mount includes a second plate secured to the second upright members of the door frame, a second flat member located adjacent the second plate, the second linear actuator being operatively connected to the second flat member, and second fasteners connecting the second member to the second plate in a selected location on the second plate.

9. The combined door and frame assembly of claim 1 including:

a first mount secured to the door frame and the first linear actuator, a second mount secured to the door frame and the second linear actuator, the first mount includes a first plate secured to the first upright members of the door frame, a plurality of horizontal slots extended through the first plate, a first flat member located adjacent the first plate, the first linear actuator being operatively connected to the first flat member, and first fasteners extended through the horizontal slots in the first plate for connecting the first flat member to the first plate in a selected location on the first plate, the second mount including a second plate secured to the second upright members of the door frame, a second plate secured to the second upright members of the door frame, a plurality of horizontal slots extended through the second plate, a second flat member located adjacent the second plate, the second linear actuator being operatively connected to the second flat member, and second fasteners extended through the horizontal slots in the second plate for connecting the second flat member to the second plate in a selected location on the second plate.

10. A combined door and frame assembly comprising:

a door including a door frame having a horizontal member, first upright members secured to the horizontal member and second upright members secured to the horizontal member, a frame assembly for supporting the door for pivotal movement between a door open position and a door closed position, said frame assembly including a generally horizontal header, a first upright column and a second upright column, said header having a first end and a second end opposite the first end, the first upright column having an upper end located adjacent the first end of the header, the second upright column having an upper end located adjacent the second end of the header, a first splice assembly secured to the first end of the header, the first splice assembly includes an upright first body, the upright first body having a first edge and a second edge on opposite sides of the upright first body, a first member operatively connected to the first upright column and engageable with the first edge of the upright first body to hold the second edge of the upright first body in engagement with the first upright column, first upright ribs secured to the upright first body, the first upright ribs having outer ends spaced away from the upright first body, first fasteners securing the first splice assembly to the upper end of the first upright column, the first fasteners being operatively connected to the upright first body and the first upright column to hold the outer ends of the first upright ribs in engagement with the first upright column, a second splice assembly secured to the second end of the header, the second splice assembly includes an upright second body, second upright ribs secured to the upright second body, the second upright ribs having outer ends spaced from the upright second body, second fasteners securing the second splice assembly to the upper end of the second upright column, the second fasteners being operatively connected to the upright second body and the second upright column to hold the outer ends of the second upright ribs in engagement with the second upright column, the upright second body having a third edge and a fourth edge opposite the third edge, a second member operatively connected to the second upright column and engageable with the third edge of the upright second body to hold the fourth edge of the upright second body in engagement with the second upright column, a plurality of hinges supporting and pivotally connecting the door frame to the header for pivotal movement of the door between the door open position and the door closed position, at least one of said hinges includes a horizontal hinge member secured to the header of the frame assembly, supports secured to the horizontal hinge member, arms secured to one of the first and second upright members of the door frame, a tubular sleeve secured to the arms, and a pin extended through the supports, the arms and the tubular sleeve to pivotally support the door frame on the header to allow the door to move between the door open position and the door closed position, a first linear actuator operatively connected to the first upright column and the door frame, and a second linear actuator operatively connected to the second upright column and the door frames, the first and second linear actuators being operable to move the door relative to the frame assembly between the door open position and the door closed position.

11. The combined door and frame assembly of claim 10 wherein:

the first upright members of the door frame include a pair of first upright members, the second upright members of the door frame include a pair of second upright members, the arms include a plurality of first arms and a plurality of second arms, the plurality of hinges include a first hinge located adjacent to the first splice assembly, and secured to the pair of first upright members of the door frame, the plurality of hinges include a second hinge located adjacent to the second splice assembly and secured to the pair of second upright members of the door frame.

12. The combined door and frame assembly of claim 10 including:

a mount secured to the door frame and the first linear actuator, said mount including a plate secured to the first upright members of the door frame, said plate having a first side, a second side and plurality of horizontal slots extending through the plate, a flat member located in contact with the first side of the plate, the first linear actuator being operatively connected to the flat member, a bar located in contact with the second side of the plate, and fasteners extending through the slots in the plate for connecting the flat member and the bar and the clamping the flat member and the bar on the plate.

13. The combined door and frame assembly of claim 10 including:

a block secured to the pin, and a stop secured to one of the supports, said stop being engageable with the block to prevent rotation of the pin relative to the arms and tubular sleeve.

14. The combined door and frame assembly of claim 10 wherein:

the plurality of hinges comprise a first hinge located in vertical alignment with the first upright members and a second hinge located in vertical alignment with the second upright members.

15. The combined door and frame assembly of claim 10 including:

a member joined to the pin, and a stop on one of the supports, said stop being engageable with the member joined to the pin to prevent rotation of the pin relative to the arms and the tubular sleeve.

16. The combined door and frame assembly of claim 10 wherein:

a first mount secured to the door frame and the first linear actuator, a second mount secured to the door frame and the second linear actuator, the first mount includes a first plate secured to the first upright members of the door frame, a first flat member located adjacent the first plate, the first linear actuator being operatively connected to the first flat member, and a first fastener connecting the first flat member to the first plate in a selected location on the first plate, the second mount includes a second plate secured to the second upright members of the door frame, a second flat member located adjacent the second plate, the second linear actuator being operatively connected to the second flat member, and second fasteners connecting the second flat member to the second plate in a selected location on the second plate.

17. The combined door and frame assembly of claim 10 including:

a first mount secured to the door frame and the first linear actuator, a second mount secured to the door frame and the second linear actuator, the first mount includes a first plate secured to the first upright members of the door frame, a plurality of horizontal slots extending through the first plate, a first flat member located adjacent the first plate, the first linear actuator being operatively connected to the first flat member, and first fasteners extended through the horizontal slots in the first plate for connecting the first flat member to the first plate in a selected location on the first plate, the second mount including a second plate secured to the second upright members of the door frame, a plurality of horizontal slots extended through the second plate, a second flat member located adjacent the second plate, the second linear actuator being operatively connected to the second flat member, and second flat fasteners extended through the horizontal slots in the second plate for connecting the second member to the second plate in a selected location on the second plate.

* * * * *